US006310305B1

(12) United States Patent
Kamino et al.

(10) Patent No.: US 6,310,305 B1
(45) Date of Patent: Oct. 30, 2001

(54) SAFETY SWITCH

(75) Inventors: Yasushi Kamino; Takao Fukui, both of Osaka (JP)

(73) Assignee: Idec Izumi Corporation, Osaka (JP)

( * ) Notice: Subject to any disclaimer, the term of this patent is extended or adjusted under 35 U.S.C. 154(b) by 0 days.

(21) Appl. No.: 09/623,438

(22) Filed: Sep. 5, 2000

(30) Foreign Application Priority Data

Jan. 14, 1999 (JP) ..... 11-008409

(51) Int. Cl.[7] ..... H01H 9/28
(52) U.S. Cl. ..... 200/43.11; 200/61.62
(58) Field of Search ..... 200/43.11, 43.07, 200/43.64, 61.52, 61.62

(56) References Cited

U.S. PATENT DOCUMENTS 5,464,954 * 11/1995 Kimura et al. ..... 200/61.62
6,118,087 * 9/2000 Fukui ..... 200/43.04

FOREIGN PATENT DOCUMENTS 0869524 10/1998 (EP) .
7-134924 5/1995 (JP) .
8-111145 4/1996 (JP) .
8-148062 6/1996 (JP) .
8-159388 6/1996 (JP) .
8-167350 6/1996 (JP) .
9-245584 9/1997 (JP) .
11-25810 1/1999 (JP) .

* cited by examiner

*Primary Examiner*—Paula Bradley
*Assistant Examiner*—Nhung Nguyen
(74) *Attorney, Agent, or Firm*—Jordan and Hamburg LLP

(57) ABSTRACT

A main lock mechanism and an auxiliary lock mechanism are juxtaposed with a switch body. The main lock mechanism including a switchable portion switchable between Lock position and Unlock position, an operation piece removably mounted to the switchable portion for switching the switchable portion, and a lock body which, when an actuator is inserted, disables or enables the rotation of a drive cam depending upon whether the switchable portion is at Lock position or Unlock position. The auxiliary lock mechanism including a drive portion actuated at transfer of the switchable portion to Lock position, an auxiliary contact alternating between a closed position and an open position depending upon whether the drive portion is non-operative or operative, and an operative portion which maintains the switchable portion at Lock position when the drive portion is non-operative and permits transfer of the switchable portion to Unlock position when the drive portion is operative.

7 Claims, 24 Drawing Sheets

SAFETY SWITCH

TECHNICAL FIELD

The present invention relates to a safety switch assembly mounted at place on a wall such as near a doorway to a room with an industrial machine installed therein and operative to shut off the power to the industrial machine when a door at the doorway is opened.

BACKGROUND ART

In dangerous zones such as rooms or plants with the industrial machines installed therein, the provision of a lock system is required for locking the machine drive at incomplete closure of the door to the dangerous zone in order that trouble of injury of an operator getting caught in the machine is obviated.

As such a lock system, there has been proposed to the art a safety switch assembly of an arrangement shown in FIGS. 16 to 26.

The safety switch assembly is electrically connected to an industrial machine installed in a room and consists of a switch body 101 and an actuator 102, as shown in FIGS. 16 to 18. The switch body 101 is secured to a wall surface near a doorway to the room, whereas the actuator 102 is secured to a door 103. The actuator is positioned in corresponding relation to a slot 101*a* of the switch body 101 so as to enter an operation section 111 of the switch body 101 when the door 103 is closed.

The ingress of the actuator 102 closes a connection contact of a contact block 9 incorporated in a switch section 112, thereby providing power supply to the machine in the room for machine drive. When, on the other hand, the door 103 is opened to remove the actuator 102 from the operation section 111, the operation section 111 returns to its initial state with the open connection contact of the contact block 9, thereby shutting off the power to the machine.

As shown in FIG. 16, the actuator 102 consists of a pressure piece 121 and a pair of support pieces 122, 123 supporting the pressure piece. The pressure piece 121 is formed with projected pressure faces 121*b*, 121*b* at opposite ends thereof and a depressed pressure face 121*a* interposed therebetween.

Next, description will be made on the arrangement of the operation section 111. As shown in FIGS. 19 to 23, the operation section 111 includes a drive cam 1 in the center thereof, which is rotatably carried by a support frame 11 via a cam shaft 4 for moving an operative rod 8 of the switch section 112.

The drive cam 1 is formed with rectangular recesses 1*a*, 1*b* in its outer periphery for receiving the pressure piece 121 of the actuator 102, the recesses adapted to correspond to a slot 101*a* or 101*b*. The drive cam 1 is also formed with a cam groove 1*c* on the opposite side from the recesses 1*a*, 1*b* with respect to the cam shaft 4. A cam follower pin 6 is inserted through the cam groove 1*c*.

Opposite ends of the cam follower pin 6 reach the proximity of the support frame 11 and are supported by guide grooves 7*a*, 7*b* of pin guides 7, respectively. The guide grooves 7*a*, 7*b* serve to limit the movement of the cam follower pin 6 in one direction and are formed along straight lines each extending through the center of the cam shaft 4 and parallel to the movement of the operative rod 8.

The cam follower pin 6 is coupled to an end of the operative rod 8 so that the movement of the cam follower pin 6 causes the operative rod 8 to move forward or backward to switch the connection contact of the switch section 112 between a closed position and an open position.

The actuator is provided with control plates 2, 3 on lateral sides thereof. The pair of control plates 2, 3 are disposed in corresponding relation to the projected pressure faces 121*b*, 121*b* of the actuator 102 and are rotatably carried by the cam shaft 4. Torsion coil springs 5, 5 are mounted to respective places between the control plates 2, 3 and the support frame 11 (shown in FIGS. 19 and 20) for returning the control plates 2, 3 to their respective initial positions. The torsion coil spring 5, 5 has one end thereof fixed to the support frame 1 and the other to the control plate 2, 3.

The control plates 2, 3 are each formed with a relief hole 2*a*, 3*a*, an edge of which is defined with a notch 2*b*, 3*b* for restricting the movement of the cam follower pin 6.

The notch 2*b*, 3*b* is cut into a semi-circular shape to receive the cam follower pin 6, as shown in FIG. 23. When the control plate 2, 3 is in the initial state (shown in FIGS. 20 and 21), the notch is positioned ahead of the cam follower pin 6 with respect of the movement thereof, as shown in FIG. 24A.

In the above arrangement, the drive cam 1 and the control plates 2, 3 in the initial state shown in FIGS. 20 and 21 are located in such a positional relation as to produce a rotational phase difference corresponding to a level difference between the depressed pressure face 121*a* and the projected pressure faces 121*b*, 121*b* of the actuator 102.

Now referring to FIGS. 24A, 24B and 24C, the operations will be described. Incidentally, although FIGS. 24A to 24C omits the reference character 3 for the unillustrated control plate on the left side as viewed from the slot 101*a* of the operation section 111, the control plate will be represented as "2, 3" herein because the pair of control plates operate in the same manner in this embodiment.

When the actuator 102 enters an interior of the operation section 111 through the slot 101*a*, the depressed pressure face 121*a* and projected pressure faces 121*b*, 121*b* at a distal end thereof first come into contact with the drive cam 1 and the control plates 2, 3, respectively (see FIGS. 24*a*). At this point of time, the cam follower pin 6 is not moved, staying at a cam-shaft-side end of the cam groove 1*c* of the drive cam 1.

Further ingress of the actuator 102 brings the drive cam 1 and control plates 2, 3 into rotation to advance the cam follower pin 6 along the cam groove 1*c* and to displace the notches 2*b*, 3*b* of the control plates 2, 3 out of the travel path of the follower pin 6 (see FIG. 24B). Subsequently, when the actuator 102 is further advanced to an insertion end, the connection contact of the switch section 112 is closed while the pressure piece 121 of the actuator 102 is fit in the recess 1*a* of the drive cam 1, as shown in FIG. 24C.

When the control plates 2, 3 are rotated in the above operations, the torsion coil springs 5, 5 are twisted in the direction of rotation so that the control plates 2, 3 are subject to a torque in the opposite direction to the rotation (returning force) resulting from the resilient force of the springs.

In removal of the actuator 102 from the position shown in FIG. 24C, the pressure piece thereof 121 pushes an inside surface of the recess 1*a* thereby bringing the drive cam 1 into the reverse rotation of that during the ingress of the actuator. This permits the operative rod 8 to retreat, returning the connection contact to its initial position (open) while the recess 1*a* of the drive cam 1 returns to its initial position shown in FIG. 24A. On the other hand, the control plates 2, 3 are urged back to their initial positions by the torsion coil springs 5,5, thus replacing the pin-lock notches 2*b*, 3*b* on the travel path for the cam follower pin 6.

Although the operations of the operation section are described by way of example where the actuator 102 is inserted in the slot 101*a* on a front side of the operation section 111, which include the two slots 101*a* and 101*b*. However, when the actuator 102 is inserted in the slot 101*b* on a top side of the operation section 111, the same operations as shown in FIGS. 24A to 24C take place. That is, the drive cam 1 and control plates 2, 3 are rotated to advance the operative rod 8 thereby switching the connection contact while the pressure piece 121 of the actuator 102 is fitted in the recess 1*b* of the drive cam 1.

At this time, any attempt to rotate the drive cam 1 with an operating plate (such as a screwdriver or the like) other than the dedicated actuator 102 is disabled by the control plates 2, 3.

When a pressure plate D is inserted through a central portion of the slot 101*a* (or 10*b*) to be pressed against the recess 1*a* (or 1*b* ) of the drive cam 1, as shown in FIG. 25A, the drive cam is rotated a little as shown in FIG. 25B. However, when the pressure plate D approaches the control plates 2, 3, the notches 2*b*, 3*b* of the control plates control the forward movement of the cam follower pin 6 while the guide grooves 7*a*, 7*a* of the pin guides 7 hold the cam follower pin 6, controlling the movement thereof in the rotation direction. Thus, the cam follower pin 6 cannot move forward nor in the rotation direction, disabling the rotation of the drive cam 1.

Even if both or either of the control plates 2, 3 is rotated using the pressure plate D, the drive cam 1 never rotates. In the initial state of the drive cam 1 and control plates 2, 3 as shown in FIG. 26A, the cam follower pin 6 is positioned out of interference with the notches 2*b*, 3*b* of the control plates 2, 3. Therefore, as shown in FIG. 26B, the attempt to rotate the control plates 2, 3 by pushing them with the pressure plate D only results in the rotation of the control plates 2, 3 alone while the drive cam 1 stands still with no force applied thereto.

In the safety switch assembly, the drive cam 1 is adapted to rotate to switch the connection contact of the contact block 9 incorporated in the switch section 112 only when the depressed pressure face 121*a* and projected pressure faces 121*b*, 121*b* of the actuator 102 substantially simultaneously press the drive cam 1 and the control plates 2, 3 on the opposite sides thereof. Hence, even if an attempt to rotate the drive cam 1 is made by inserting a tool with a flat tip, such as a screwdriver, into the operation section 111, the rotation of the drive cam 1 is prevented for inhibition of the operation of the operation section 111.

However, a problem exists with the arrangement wherein the ingress of the actuator into the operation section 111 enables the drive of the machine in the room but the egress of the actuator 102 from the operation section 111 at the opening of the door 103 returns the operation section 111 to its initial state to shut off the power to the machine whereby the operator is allowed to enter the room. That is, the arrangement involves fear that if a third person unaware of the presence of the operator in the room inadvertently closes the door 103, the actuator 102 is re-inserted in the operation section 111 to enable the drive of the machine in the room in which the operator is locked.

The conventional safety switch assembly mentioned above involves the possibility of occurrence of such an event because the ON/OFF control of the power supply to the industrial machine in the room depends upon whether the actuator 102 is inserted in the operation section 111 or not.

The invention contemplates the solution to the above problem and is directed to prevent the inadvertent closure of the door or the like from enabling the power supply to the industrial machine in the presence of the operator in the dangerous zone and to prevent the operator from being locked in the dangerous zone.

DISCLOSURE OF THE INVENTION

According to the invention for achieving the above object, a safety switch assembly for providing ON/OFF control of a main circuit via a connection contact switched by an operative rod of a switch section moved by an actuator inserted in an operation section of a switch body is characterized in that the operation section includes a drive cam formed with a lock step in its periphery and rotated according to ingress or egress of the actuator; that a main lock mechanism is juxtaposed with the switch body and comprises a switchable portion selectively switched between Lock position and Unlock position, an operation piece removably mounted to the switchable portion for switching operation of the switchable portion and becoming removable at transfer of the switchable portion to Unlock position, and a lock body which, during the ingress of the actuator, is locked to the lock step as interlocked with the switchable portion switched to Lock position thereby disabling the rotation of the drive cam for inhibition of the egress of the actuator and is released from the lock step as interlocked with the switchable portion switched to Unlock position thereby enabling the rotation of the drive cam for permission of the egress of the actuator; that an auxiliary lock mechanism is juxtaposed with the switch body and comprises a drive portion operated by a trigger externally applied when the switchable portion is at Lock position, an auxiliary contact connected in series with the main circuit jointly with the connection contact, and an operative portion which, during a non-operative state of the drive portion, maintains the switchable portion at Lock position for keeping the auxiliary contact closed and which, during an operative state of the drive portion, permits transfer of the switchable portion to Unlock position for opening the auxiliary contact; and that the main circuit is closed on condition that the drive portion of the auxiliary lock mechanism is non-operative, the switchable portion of the main lock mechanism is at Lock position and the actuator is inserted.

In this arrangement, even if the door is open with the actuator uninserted and then is inadvertently closed to insert the actuator despite the presence of the operator in the room as the dangerous zone wherein the industrial machine is installed, the main circuit stays open disabling the power supply to the industrial machine unless the drive portion of the auxiliary lock mechanism is switched to the non-operative state thereby to switch the switchable portion of the main lock mechanism to Lock position.

In short, the main circuit is closed only when the drive portion of the auxiliary lock mechanism is non-operative, the switchable portion of the main lock mechanism is at Lock position and the actuator is inserted. This obviates the event that the power supply to the industrial machine is started by the inadvertent closure of the door when the operator is present in the dangerous zone or that the operator is locked in the dangerous zone.

According to the invention, the safety switch assembly is further characterized in that constraining means is provided for constraining the lock body for inhibition of the transfer of the switchable portion from Unlock position to Lock position when the actuator is not inserted.

In this arrangement, unless the door is closed to insert the actuator, for example, the constraining means constrains the lock body thereby to inhibit the transfer of the switchable portion to Lock position. Therefore, the safety of the operator is ensured even if, for example, the operator is present in the room as the dangerous zone and the door is inadvertently closed to insert the actuator. This is because the operation piece is incapable of transferring the switchable portion from Unlock position to Lock position as long as it is separate from the switchable portion and because the ingress of the actuator does not immediately effect the closure of the main circuit.

According to the invention, the safety switch assembly is further characterized in that the operation piece comprises a key; and that the switchable portion comprises a key-insertion portion for receiving the key, an operation cam rotated by turning the key inserted in the key-insertion portion, a cam groove defined in the operation cam, an insert pin inserted in the cam groove, and a move body which is urged by urging means in an egress direction of the actuator but is moved from Lock position to Unlock position against the urging means as interlocked with the insert pin moved by the rotation of the operation cam.

In this arrangement, the operation piece comprised of the key is easy to use while the move body of the switchable portion may readily be switched by mere turning of the key inserted in the key-insertion portion of the switchable portion. If keys are individually formed in different shapes for incompatibility, access to the dangerous zone may be limited to the operator having a key of a specific shape. Hence, the dedicated operator to the services and the prevention of misoperation of the machine contribute enhanced security.

According to the invention, the safety switch assembly is further characterized in that the drive portion of the auxiliary lock mechanism comprises a solenoid excited by the trigger; that the operative portion of the auxiliary lock mechanism comprises a plunger attractively moved by the excited solenoid and urged back to its initial place by the urging means when the solenoid is deexcited; that the operation cam is formed with a recess for removably receiving a distal end of the plunger; that the plunger has its distal end received by the recess thereby inhibiting the rotation of the operation cam for maintaining the move body at Unlock position; and that the plunger is attractively moved to disengage its distal end from the recess thereby permitting the rotation of the operation cam.

In this arrangement, the distal end of the plunger is inserted in the recess to disable the rotation of the operation cam so that the move body is maintained in Unlock position. Therefore, if in this state, the operation piece in the form of the key is inserted in the switchable portion of the main lock mechanism, the operation piece cannot be turned, thus disabled from switching the move body to Lock position. Accordingly, even if the door is inadvertently closed to insert the actuator, the move body cannot be transferred to Lock position unless the excited solenoid attractively moves the plunger for disengaging the distal end thereof from the recess. Thus, the ingress of the actuator does not immediately effect the closure of the main circuit.

According to the invention, the safety switch assembly is further characterized in that the operation piece includes one that is also used for the drive of a system besides the main circuit.

This arrangement provides for such procedures that after removing the operation piece from the switchable portion of the main lock mechanism, the operator enters a room, as the dangerous zone where an additional system as well as the main circuit are installed, and uses the operation piece to drive the additional system. Thus, the operator can safely perform the maintenance services on the additional system in the dangerous zone.

According to the invention, the safety switch assembly is further characterized in that the trigger is applied by a manual operation or a control unit on condition that an electrical equipment connected to the main circuit is shut down.

In this arrangement, unless the electrical equipment is shut down, the drive portion of the auxiliary lock mechanism cannot be actuated to transfer the switchable portion of the main lock mechanism to Unlock position where the lock body of the main lock mechanism permits the egress of the actuator (for example, permit the door to be opened). Hence, the operator is prevented from entering the dangerous zone when the electrical equipment is in operation.

According to the invention, the safety switch assembly is further characterized in that the switch body is secured to place near a doorway formed in a partitioning wall defining a specific area in a building; that the actuator is secured to a door disposed at the doorway; and that when the actuator is removed from the operation section by opening the door, the operation piece becomes removable from the switchable portion to be brought by an operator with him into the specific area.

In this arrangement, if a need arises, for example, for the operator to enter the specific area containing the industrial machine equipped with the main circuit in order to perform the maintenance services on the industrial machine, the main circuit is never closed to supply the power to the industrial machine under service as long as the operator brings the operation piece with him in the specific area.

BEST MODE FOR CARRYING OUT THE INVENTION (First Embodiment)

Figure 1:
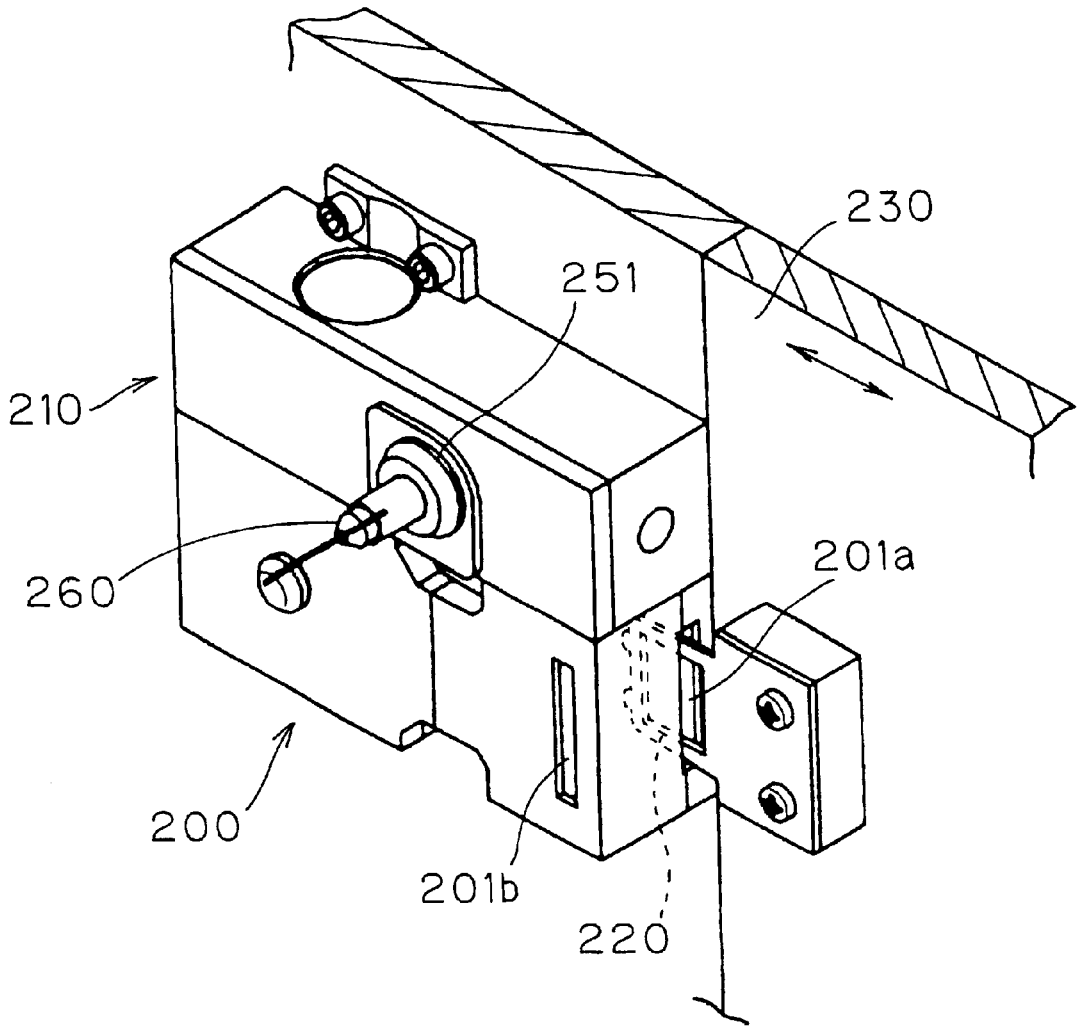
FIG. 1 is a perspective view showing a first embodiment of the invention.
Figure 2:
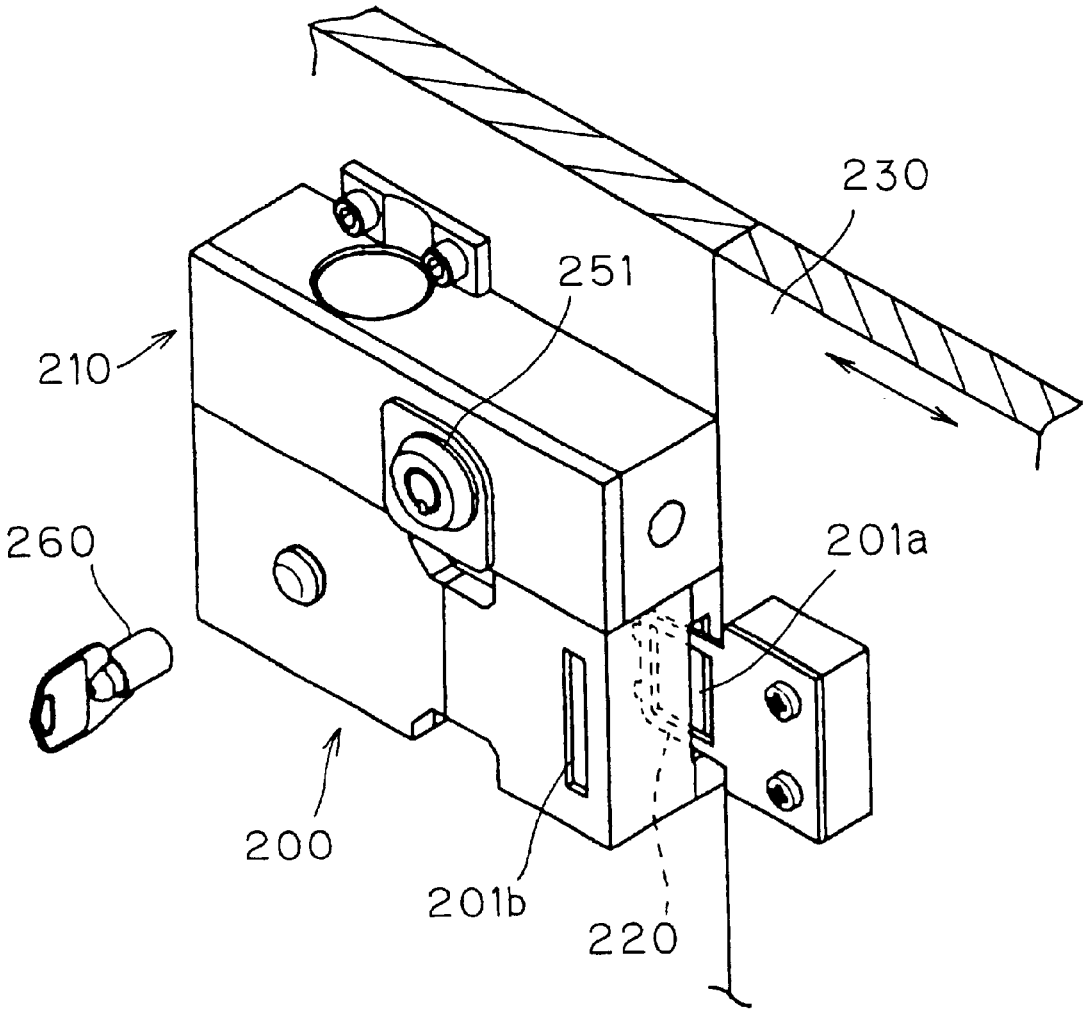
FIG. 2 is a perspective view showing the first embodiment hereof in another state.
Figure 3:
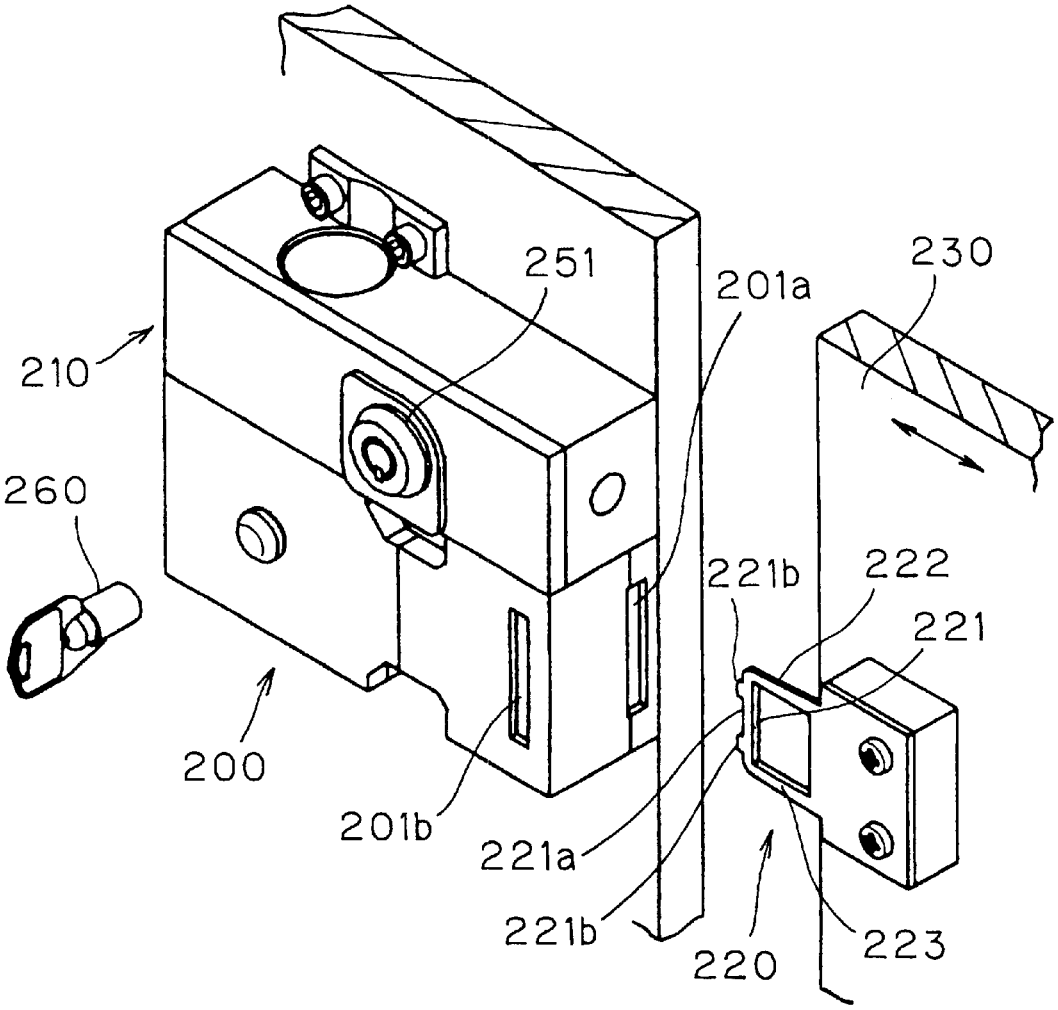
FIG. 3 is a perspective view showing the first embodiment hereof in yet another state.
Figure 4:
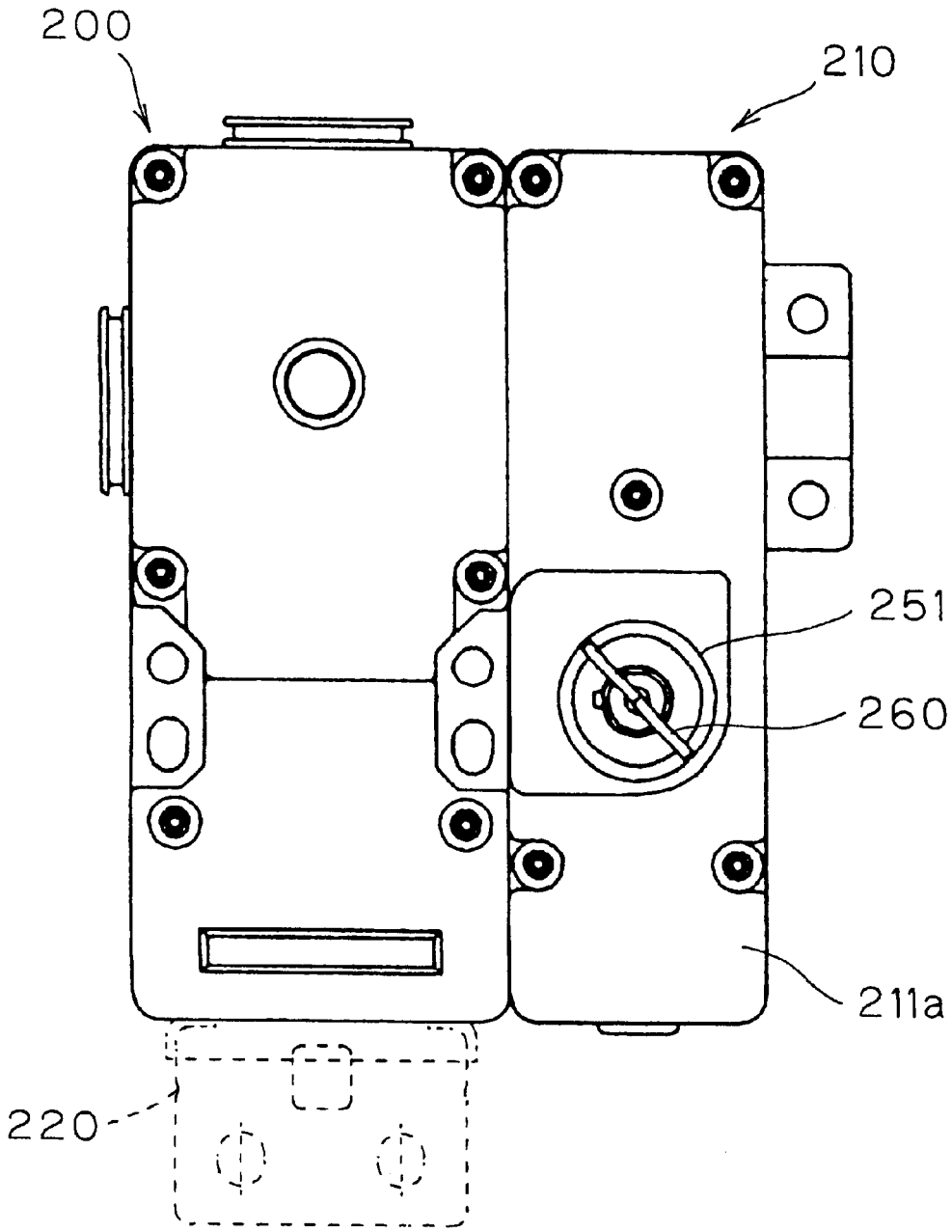
FIG. 4 is a plan view showing the first embodiment hereof.
Figure 5:
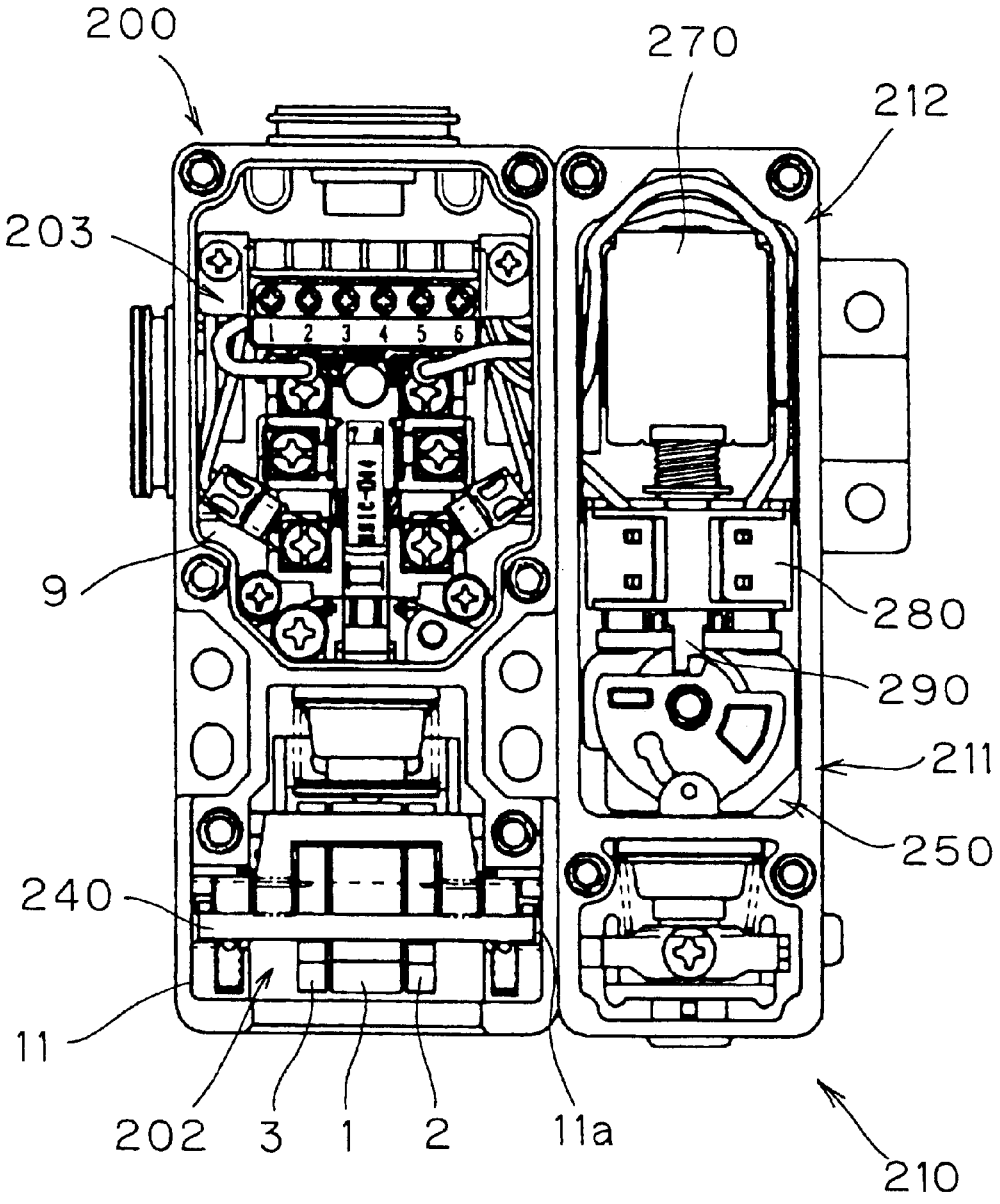
FIG. 5 is a plan view showing the first embodiment hereof without a cover.
Figure 6:
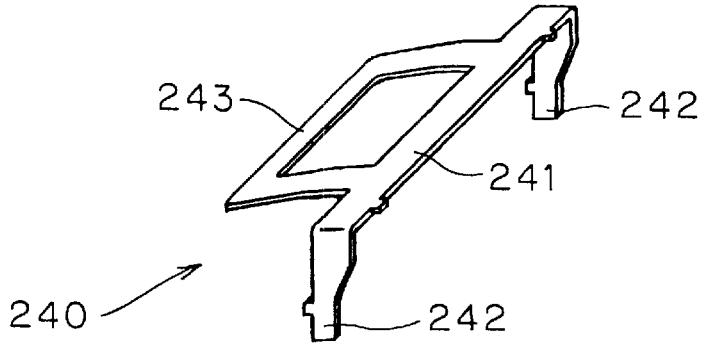
FIG. 6 is a perspective view showing a lock body according to the first embodiment hereof.
Figure 7:
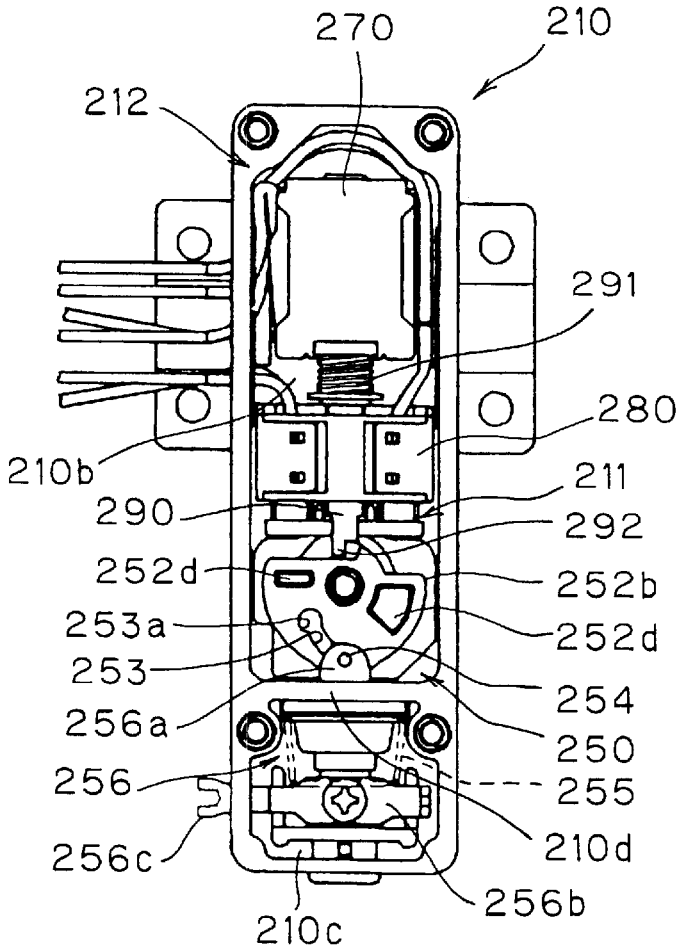
FIG. 7 is a plan view showing a lock mechanism body without a cover according to the first embodiment hereof.
Figure 8:
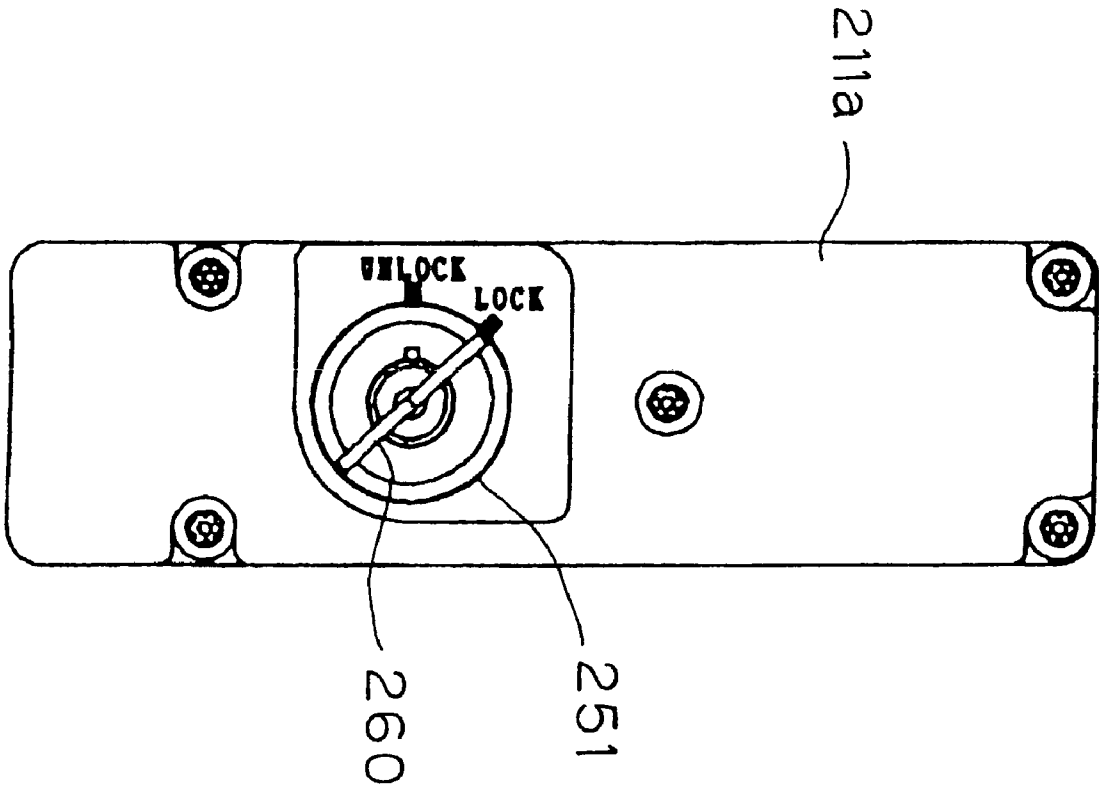
FIG. 8 is a plan view showing the lock mechanism body according to the first embodiment hereof.
Figure 9:
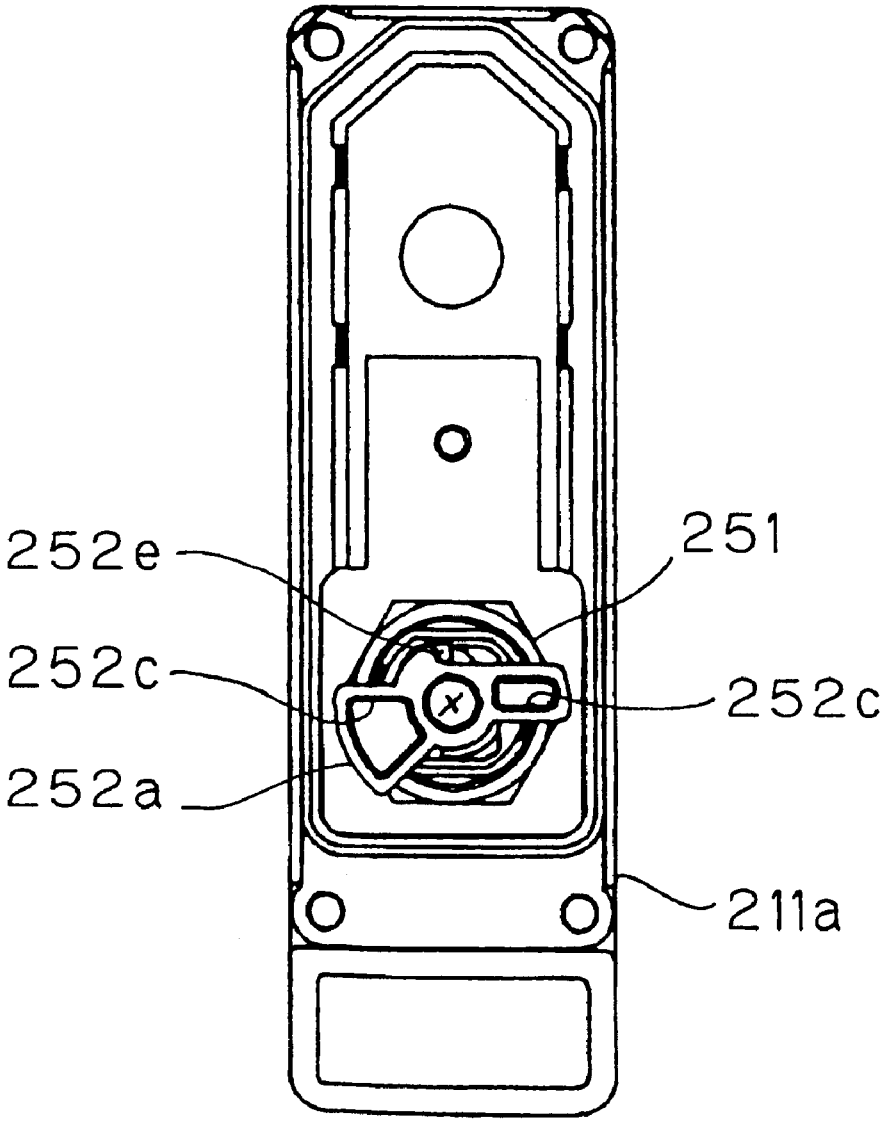
FIG. 9 is a bottom view showing the cover of the lock mechanism body according to the first embodiment hereof.

Now, a first embodiment of the invention will be described with reference to FIGS. 1 to 13. FIGS. 1 to 3 are perspective views each showing a different state of the first embodiment; FIG. 4 a plan view thereof; FIG. 5 a plan view thereof with a cover removed; FIG. 6 a perspective view of a lock body; FIG. 7 a plan view of a lock mechanism body with the cover removed; FIG. 8 a plan view of the lock mechanism body; FIG. 9 a bottom view of the cover of the lock mechanism body; FIGS. 10 to 13 plan views each showing a different state of the lock mechanism body with the cover removed.

Generally likewise to the conventional safety switch assembly mentioned supra, a safety switch assembly according to the first embodiment is electrically connected to an industrial machine installed in a room as a dangerous zone. The safety switch assembly comprises a switch body 200; a main lock mechanism body 210 juxtaposed with the switch body 200 and including a main lock mechanism 211 and an auxiliary lock mechanism 212; and an actuator 220.

Likewise to the conventional example, the switch body 200 and the lock mechanism body 210 are secured to a wall of the room near its doorway whereas the actuator 220 is secured to a door 230. The actuator 220 is positioned in corresponding relation to one 201*a* of slots 201*a*, 201*b* of the switch body 200 so as to enter an operation section 202 of the switch body 200 when the door 230 is closed.

If, at the ingress of the actuator 220, a drive portion (described later) of the auxiliary lock mechanism 212 is non-operative while the main lock mechanism 211 is in Lock position, a connection contact of a contact block 9 incorporated in a switch section 203 of the switch body 200 is closed. This closes a main circuit to energize the machine in the room so that the machine becomes drivable. On the other hand, the main circuit is opened to shut off the power to the machine in any of the cases where the drive portion of the auxiliary lock mechanism 212 is in operative state, where the main lock mechanism 211 is in Unlock position, and where the actuator 220 is removed from the operation section 202 by opening the door 230.

Likewise to the conventional example, the actuator 220 has an insertion portion into the operation section 202, which comprises a pressure piece 221 at a distal end thereof and a pair of support pieces 222, 223 supporting the pressure piece, as shown in FIG. 3. The pressure piece 221 is formed with projected pressure faces 221*b*, 221*b* at opposite ends thereof and a depressed pressure face 221*a* interposed therebetween.

The operation section 202 and switch section 203 of the switch body 200 is essentially of the same arrangement as the conventional example. The operation section 202 comprises the drive cam 1; control plates 2, 3 disposed on lateral sides of the drive cam; the cam shaft 4 for rotatably bearing these; the torsion coil springs 5 for urging the control plates 2, 3; the cam follower pin 6 and the like. The rotation of the drive cam 1 causes the cam follower pin 6 to move. This causes the operative rod 8 of the switch section 203 to advance or retreat, thereby switching the connection contact of the contact block 9 of the switch section 203 between the closed position and the open position. The drive cam 1 is rotated only when the drive cam 1 and the control plates 2, 3 are substantially simultaneously pressed by the actuator 220 inserted in the operation section 202.

Since the operation section 202 and the switch section 203 generally operate the same way as the conventional example, the following description on the operation section 202, the switch section 203 and other portions of the embodiment principally focuses on differences from the conventional example, dispensing with the redundancies.

As shown in FIG. 5, the operation section 202 is provided with a lock body 240 constituting a part of the main lock mechanism 211. The lock body 240 disables the rotation of the drive cam 1 thereby inhibiting the egress of the actuator 220 (unremovable). On the other hand, the lock body permits the rotation of the drive cam 1 as interlocked with a switchable portion 250 of the main lock mechanism 211 switched to Unlock position, thereby permitting the egress of the actuator 220 (removable).

The lock body 240 is disposed at place above the drive cam 1 and the control plates 2, 3 and comprises a support piece 241, engagement pieces 242, 242 formed by downward bending of opposite ends of the support piece 241, and a locking piece 243 formed integrally with the support piece 241 and having a U-shaped form as viewed in plan. One of the engagement pieces 242 of the support piece 241 is disposed in a recess 11*a* defined in the support frame 11 of the operation section 202 and is engaged with a part of a move body of the main lock mechanism 211 to be described later.

Next, description is made on the arrangement of the main lock mechanism 211 and auxiliary lock mechanism 212 of the lock mechanism body 210. First, the main lock mechanism 211 comprises the switchable portion 250 selectively switched between Lock position and Unlock position; an operation piece 260 removably mounted to the switchable portion 250 for switching operation of the switchable portion 250 and becoming removable at transfer of the switchable portion 250 to Unlock position; and the lock body 240.

Figure 27:
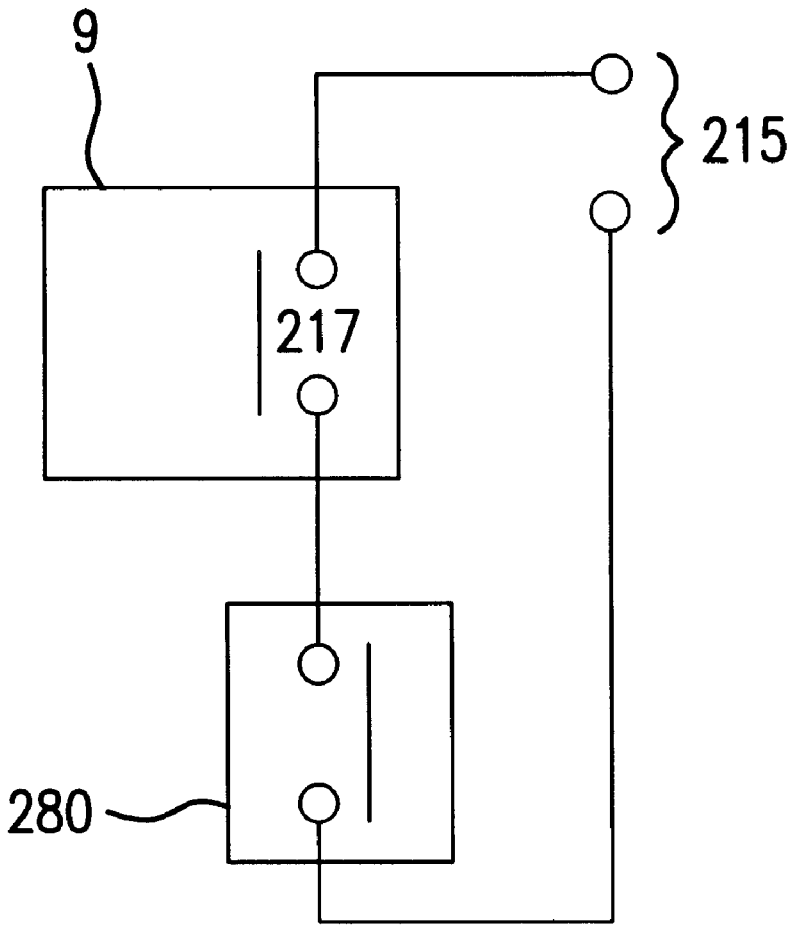
FIG. 27 shows the main circuit, the connection contact and the auxiliary contact.

The auxiliary lock mechanism 212 comprises a drive portion 270 actuated by a trigger externally applied upon transfer of the switchable portion 250 to Lock position; an auxiliary contact 280 jointly forming a series circuit with the connection contact 217 of the contact block 9 of the switch section 203 to be connected in series with the main circuit 215 and switched between the closed position and the open position depending upon whether the drive portion 270 is in the non-operative state or in the operative state; and an operative portion 290 operative to maintain the switchable portion 250 at Lock position for keeping the auxiliary contact 280 closed during the non-operative state of the drive portion 270 or to switch the switchable portion 250 to Unlock position when the drive portion 270 is operative (see also FIG. 27).

More specifically, the operation piece 260 of the main lock mechanism 211 comprises a key to be turned in a locking direction or an unlocking direction as distinctly depicted in FIGS. 2 and 3. As shown in FIGS. 7 to 9, the switchable portion 250 comprises a key-insertion portion 251 disposed at a cover 211*a* of the lock mechanism body 210 for receiving the key (operation piece) 260; an operation cam including a first cam 252*a* and a second cam 252*b* and brought into rotation by turning the key (operation piece) 260 in the key-insertion portion 251 in the locking direction or the unlocking direction; a cam groove 253 defined in the second cam 252*b* of the operation cam; an insert pin 254 inserted in the cam groove 253; and a move body 256 urged by a spring 255, as urging means, in the egress direction of the actuator 220 and moved (advanced) against the spring 255 from Lock position to Unlock position as interlocked with the insert pin 254 moved by the rotation of the second cam 252*b* of the operation cam.

As shown in FIG. 7, the spring 255 is mounted in a minor chamber 210*c* in encompassing relation to a rod 256*a* of the move body 256 and has its opposite ends locked to a partitioning wall 210*d* and an operative body 256*b* thereby urging the operative body 256*b* and the rod 256*a* toward Unlock position (in the egress direction of the actuator 220).

As shown in FIG. 9, the first cam 252*a* of the operation cam is mounted on a back side of a cover 211*a* of the key-insertion portion 251 so as to rotate as interlocked with the rotation of the key (operation piece) 260. The first cam 252*a* is formed with a concave 252*c* in its lower surface. The second cam 252*b*, as shown in FIG. 7, is formed with a convex 252*d* in its upper surface to fit in the concave 252*c* such that the engagement between the concave 252*c* and the convex 252*d* establishes interlock between the first cam 252*a* and the second cam 252*b* for rotation.

The cam groove 253 is defined in the upper surface of the second cam 252*b* and includes a pin locking portion 253*a* defined at one end thereof, as shown in FIG. 7. When the move body 256 is at Unlock position, the insert pin 254 is locked in the pin locking portion 253*a*.

Further referring to FIG. 7, the move body 256 comprises the rod 256*a*, the operative body 256*b* orthogonally mounted to the rod 256*a*, and a U-body 256*c* to be described later. The rod 256*a* extends through the partitioning wall 210*d* to be disposed in the minor chamber 210*c*, the partitioning wall dividing the interior of the lock mechanism body 210 into a major chamber 210b and the minor chamber 210*c*. The rod 256*a* is longitudinally movably carried on opposite ends thereof so as to alternate between Lock position and Unlock position. The insert pin 254 is attached to one end of the rod 254*a* extended into the major chamber 210*b* whereas the operative body 256*b* is attached to the other end of the rod 256*a* in the minor chamber 210*c*.

The operative body 256*b* is integrally formed with the U-body 256*c*, as constraining means, at one end thereof. The U-body 256*c* extends through a wall of the lock mechanism body 210 into the switch body 200, receiving a lower end of one of the engagement pieces 242 of the lock body 240. Thus, when the actuator 220 is not present in the operation section, the lock body 240 is constrained thereby to inhibit the transfer (retreat) of the move body 256 from Lock position to Unlock position.

Figure 22A:
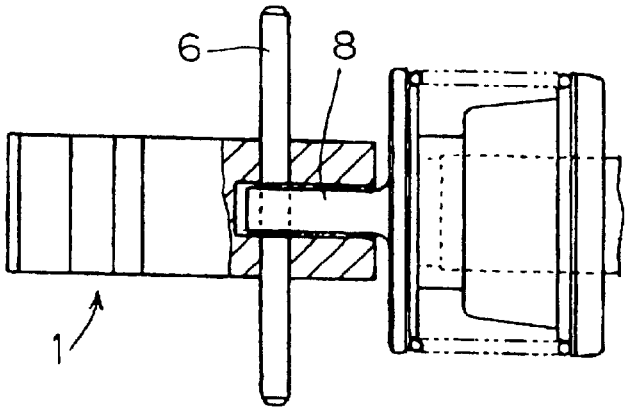
FIGS. 22A, and 22B are a group of diagrams explanatory of the operations of another part of the background art example hereof.
Figure 22B:
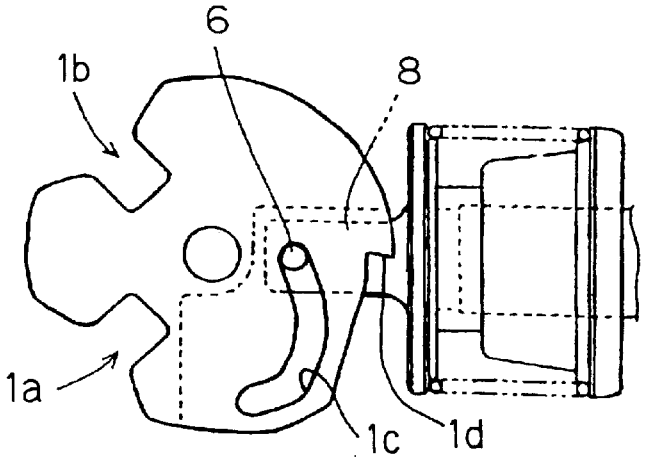
Figure 23:
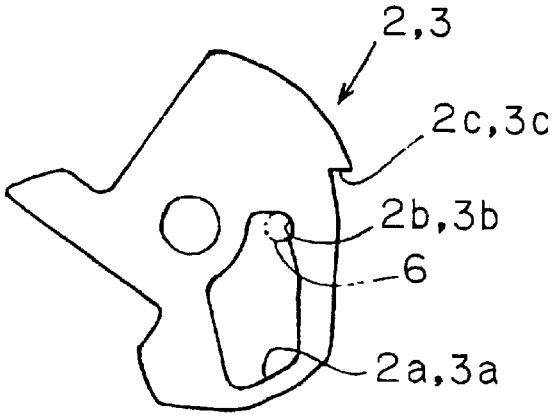
FIG. 23 is a side view showing yet another part of the background art example hereof.
Figure 24A:
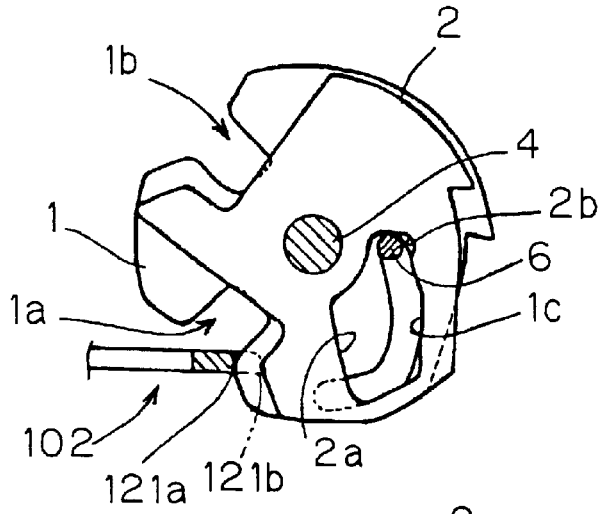
FIGS. 24A to 24C are a group of diagrams explanatory of operations of the background art example art hereof.
Figure 24B:
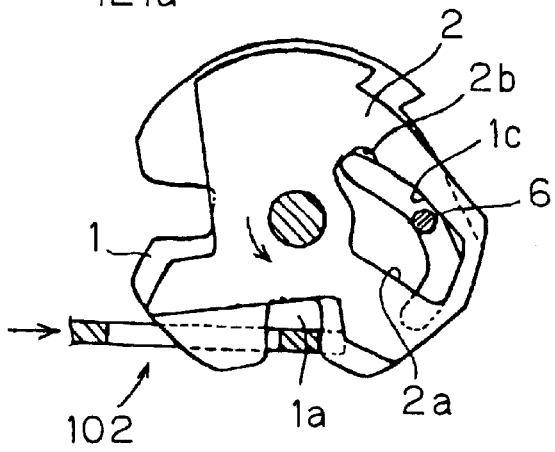
Figure 24C:
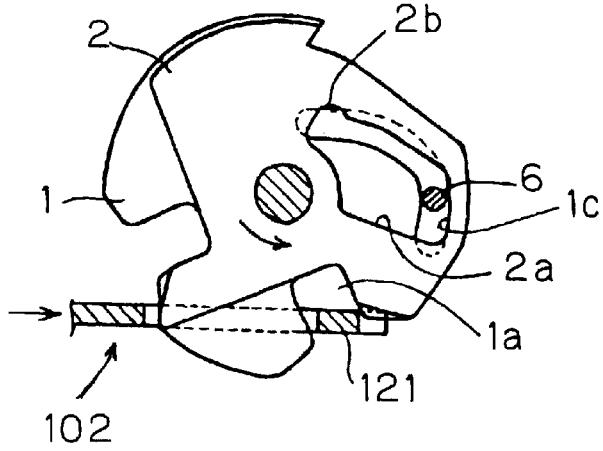
Figure 25A:
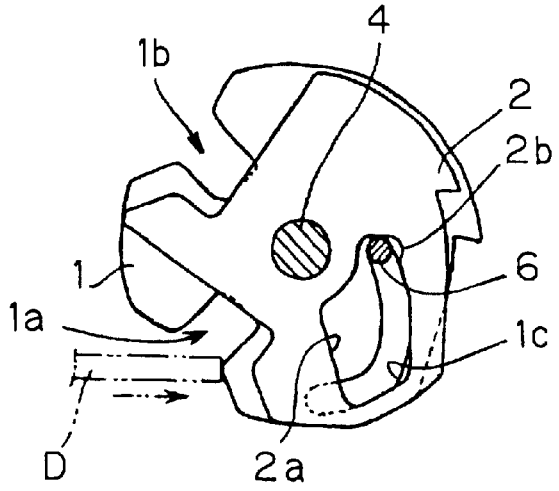
FIGS. 25A to 25C are a group of diagrams explanatory of the operations of the background art example hereof.
Figure 25B:
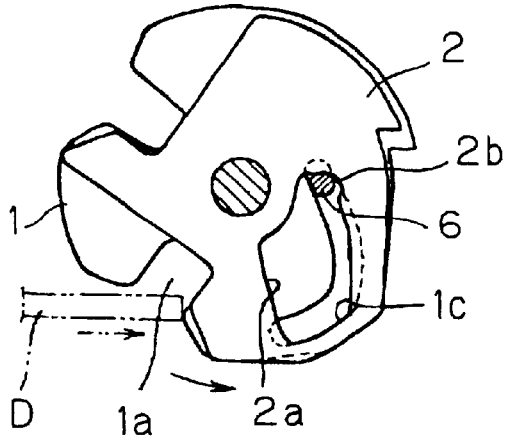
Figure 25C:
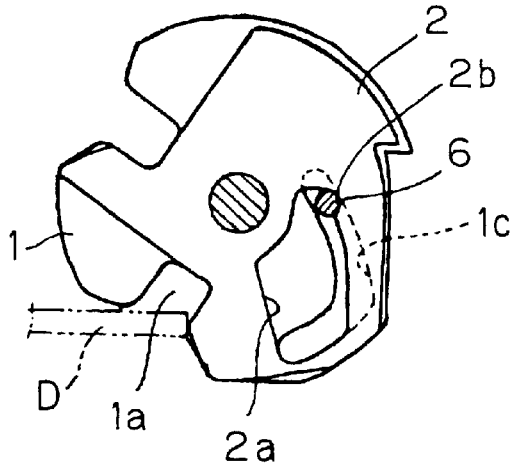
Figure 26A:
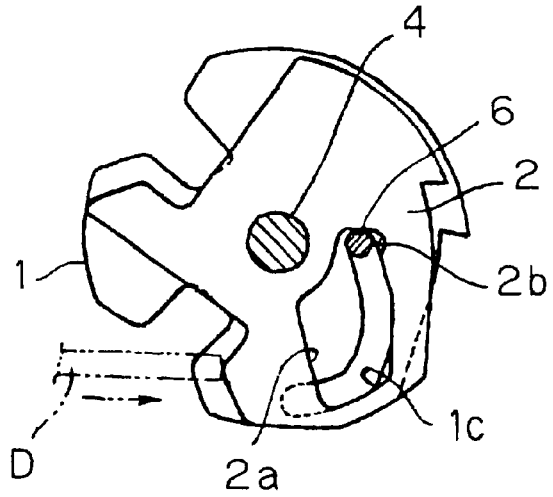
FIGS. 26A, and 26B are a group of diagrams explanatory of the operations of the background art example hereof.
Figure 26B:
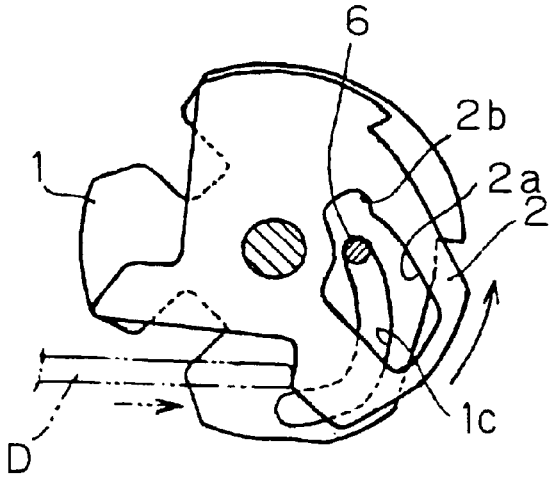

When the move body 256 is moved (retreated) to Lock position, the U-body 256*c* urges the lower end of one of the engagement pieces 242 of the lock body 240 in the retreat direction thereby bringing the lock body 240 into rotation about the support piece 241 in a direction to present the locking piece 243 thereof to the drive cam 1 and control plates 2, 3. Accordingly, the locking piece 243 is locked in lock steps 1*d* and 2*c*, 3*c* which are formed on respective peripheries of small radius portions of the drive cam 1 and control plates 2, 3 (see FIGS. 22B and 23). This inhibits the rotation of the drive cam 1 and control plates 2, 3 for inhibition of the egress of the actuator 220.

When the move body 256 of the main lock mechanism 211 is moved (advanced) to Unlock position, the U-body 256*c* urges the lower end of the one engagement piece 242 of the lock body 240 in the opposite direction to the above thereby bringing the lock body 240 into rotation about the support piece 241 in a direction to bring the locking piece 243 away from the drive cam 1 and control plates 2, 3. Accordingly, the locking piece 243 is disengaged from the lock steps 1*d* and 2*c*, 3*c* of the drive cam 1 and control plates 2, 3. Thus, the drive cam 1 and control plates 2, 3 are allowed to rotate thereby permitting the egress of the actuator 220.

The engagement between the one engagement piece 242 of the lock body 240 and the U-body 256*c* provides the following operation in a case where the actuator 220 is not inserted in the operation section 202 while the key (operation piece) 260 is removed. When the key (operation piece) 260 is inserted and turned in the locking direction to transfer (retreat) the move body 256 from Unlock position to Lock position, the U-body 256 urges the lower end of the one engagement piece 242 of the lock body 240 in the retreating direction. This causes the locking piece 243 to pivot about the support piece 241 toward the drive cam 1 and the control plates 2, 3 and to abut against peripheries of great radius portions of the drive cam 1 and control plates 2, 3. Thus, further rotation of the lock body 240 is disabled. The lock body 240 is constrained so that the move body 256 is inhibited from transferring from Unlock position to Lock position. That is, a state is established wherein the key (operation piece) 260 cannot be turned.

The drive portion 270 of the auxiliary lock mechanism 212 comprises a solenoid excited by an external trigger. The operative portion 290 of the auxiliary lock mechanism 212 comprises a plunger which is attracted by the excited solenoid (drive portion) 270 to move (advance) against a spring 291, as urging means, but is urged back (retreat) to its initial position by the spring 291 when the solenoid (drive portion) 270 is deexcited. It is noted that the spring 291 urges the plunger (operative portion) 290 in the same direction that a distal end of the plunger approaches the first cam 252*a* of the operation cam (retreat direction). The auxiliary contact 280 in series with the main circuit is opened or closed corresponding to the excitation (operative state) or deexcitation (non-operative state) of the solenoid (drive portion) 270.

When the solenoid (drive portion) 270 is deexcited, the spring 291 is allowed to urge the plunger (operative portion) 290 back to its retreat position, the distal end of the plunger (operative portion) 290 slidably moving from a great radius portion to a small radius portion of the first cam 252*a* rotated by the key (operation piece) 260 turned in the locking direction.

The external trigger for exciting the solenoid (drive portion) 270 may be applied as an electrical signal through manual operation of the operator or based on sequence of an unillustrated control unit. The application of the trigger is at least conditional on the shutoff of the power to the industrial machine connected to the main circuit.

The plunger (operative portion) 290 is formed with a projection 292 at its distal end which removably engages a protrusion 252*e* formed at the first cam 252*a* of the operation cam (see FIG. 9).

When the key (operation piece)260 inserted in the key-insertion portion 251 is turned in the locking direction, the distal end of the plunger (operative portion) 290 slidably moves on the periphery of the first cam 252*a* of the operation cam to establish the engagement between the projection 292 and the protrusion 252*e*. The engagement inhibits the rotation of the first cam 252*a* thereby to disable the key (operation piece) 260 from turning in the unlocking direction. Thus, the move body 256 is maintained at Lock position. The move body 256 may be released from Lock position by exciting the solenoid (drive portion) 270 for attraction of the plunger (operative portion) 290 whereby the projection 292 at the distal end of the plunger (operative portion) 290 is disengaged from the protrusion 252*e*.

Next, description will be made on the operations of the embodiment. If the actuator 220 enters the operation section 202 of the switch body 200 at closure of the door 230 and the key (operation piece) 260 is inserted in the key-insertion portion 251 to be turned in the locking direction, the ingress of the actuator 220 causes the rotation of the drive cam 1 and control plates 2, 3 to advance the operative rod 8 which closes the connection contact of the contact block 9 of the switch section 203. If, at this time, the solenoid (drive portion) 279 is deexcited (non-operative state), the auxiliary contact 280 is closed so that the main circuit is closed to supply the power to the industrial machine connected thereto, bringing the industrial machine into operation. The operative state of the machine will hereinafter be referred to as "State 1".

Figure 10:
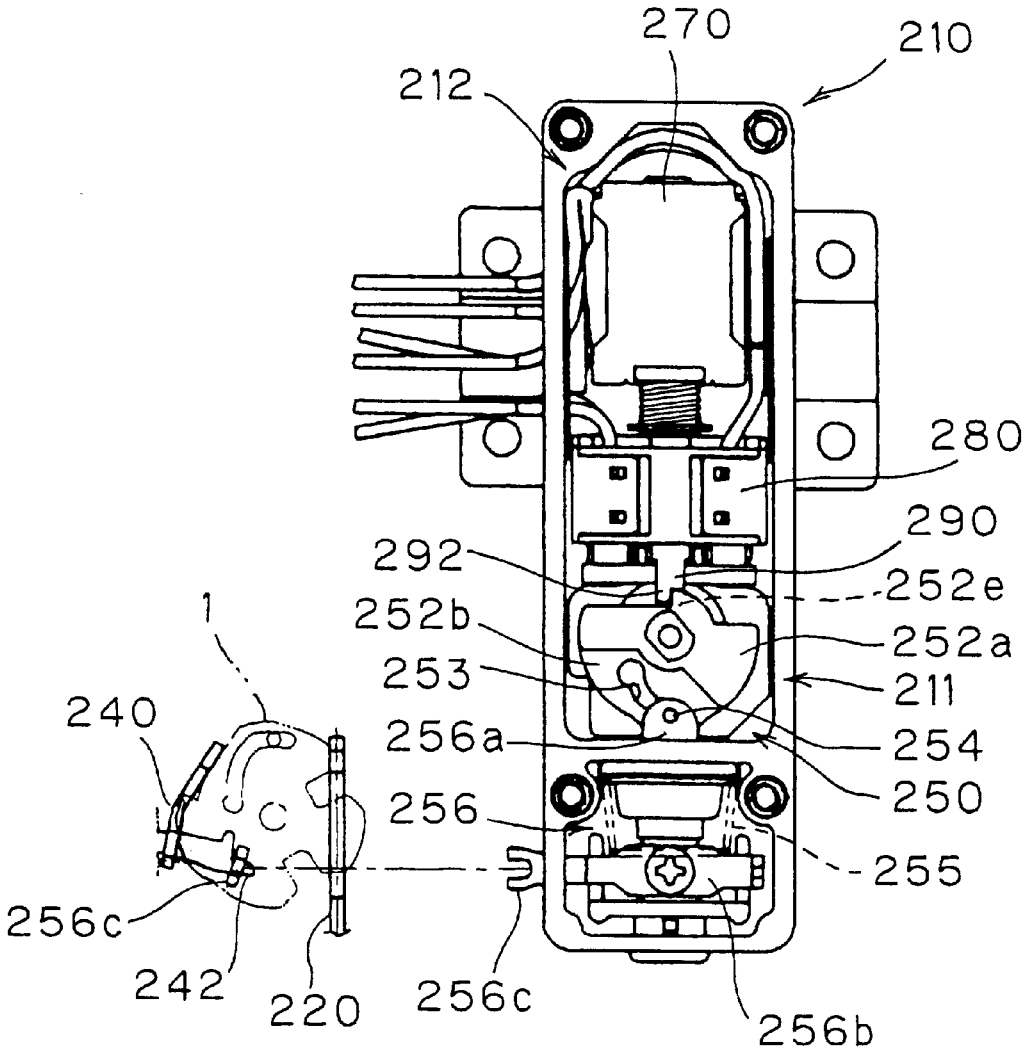
FIG. 10 is a plan view showing the lock mechanism body without the cover according to the first embodiment hereof.

In State 1, the move body 256 of the main lock mechanism 211 is moved to Lock position (retreated) as shown in FIG. 10. Therefore, the U-body 256*c* urges the lower end of the one engagement piece 242 of the lock body 240 in the retreat direction thereby bringing the lock body 240 into rotation about the support piece 241 in the direction to present its locking piece 243 to the drive cam 1 and control plates 2, 3. Thus, the locking piece 243 is locked in the lock steps 1*d*, 2*c* and 3*c* of the drive cam 1 and control plates 2, 3.

Hence, an attempt to draw out the actuator 220 is reacted by the inhibited rotation of the drive cam 1 and control plates 2, 3 due to the lock between the locking piece 243 and the lock steps 1*d*, 2*c* and 3*c* of the drive cam 1 and control plates 2, 3. As a result, the actuator 220 cannot be removed.

In State 1, the projection 292 at the distal end of the plunger (operative portion) 290 is engaged with the protrusion 252*e* and hence, the rotation of the first cam 252*a* of the operation cam is inhibited thereby disabling the key (operation piece) 260 from turning in the unlocking direction. Thus, the move body 256 is maintained at Lock position.

Figure 11:
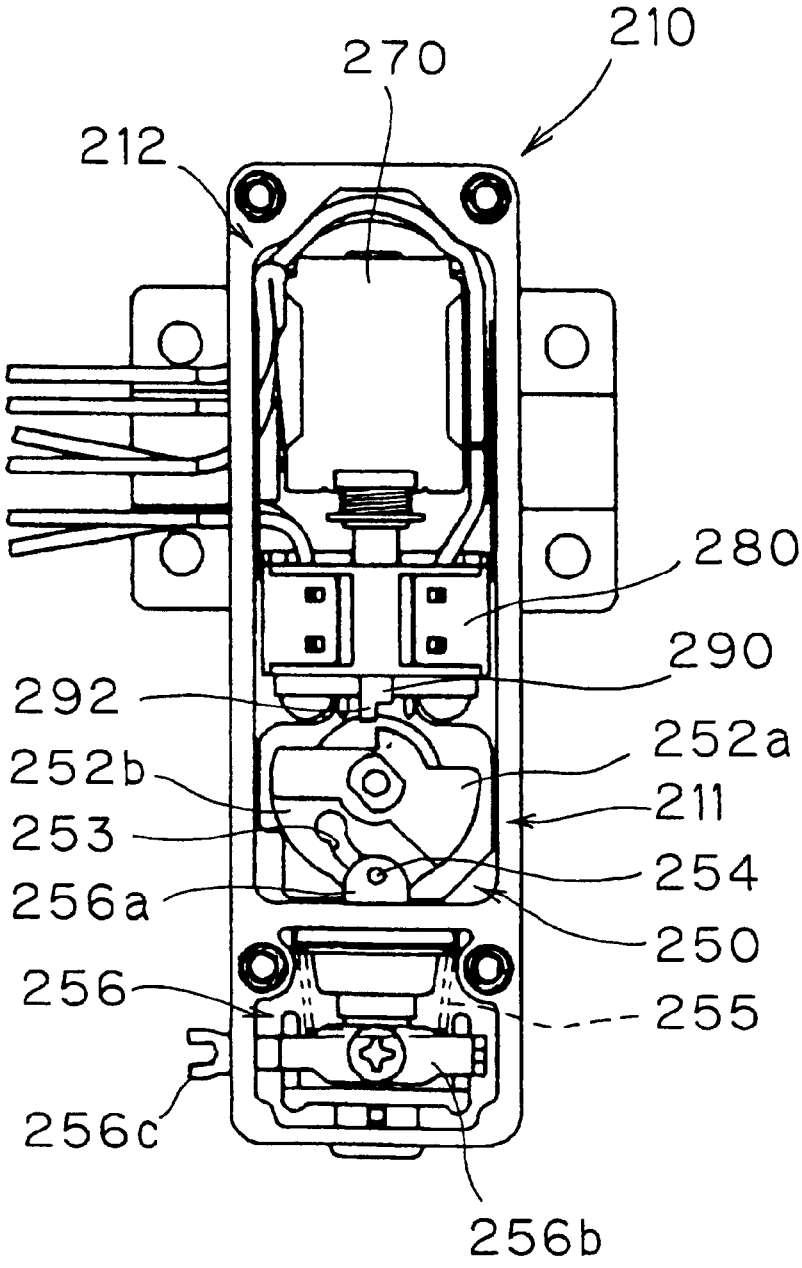
FIG. 11 is a plan view showing a state of the lock mechanism body without the cover according to the first embodiment hereof.

When the solenoid (drive portion) 270 is excited in State 1, the plunger (operative portion) 290 is attracted to advance against the spring 291, as shown in FIG. 11, thereby disengaging the projection 292 at its distal end from the protrusion 252*e*. As advanced by the excited solenoid (drive portion) 270, the plunger (operative portion) 290 opens the auxiliary contact 280. The excited state of the solenoid (drive portion) 270 will hereinafter be referred to as "State 2".

Figure 12:
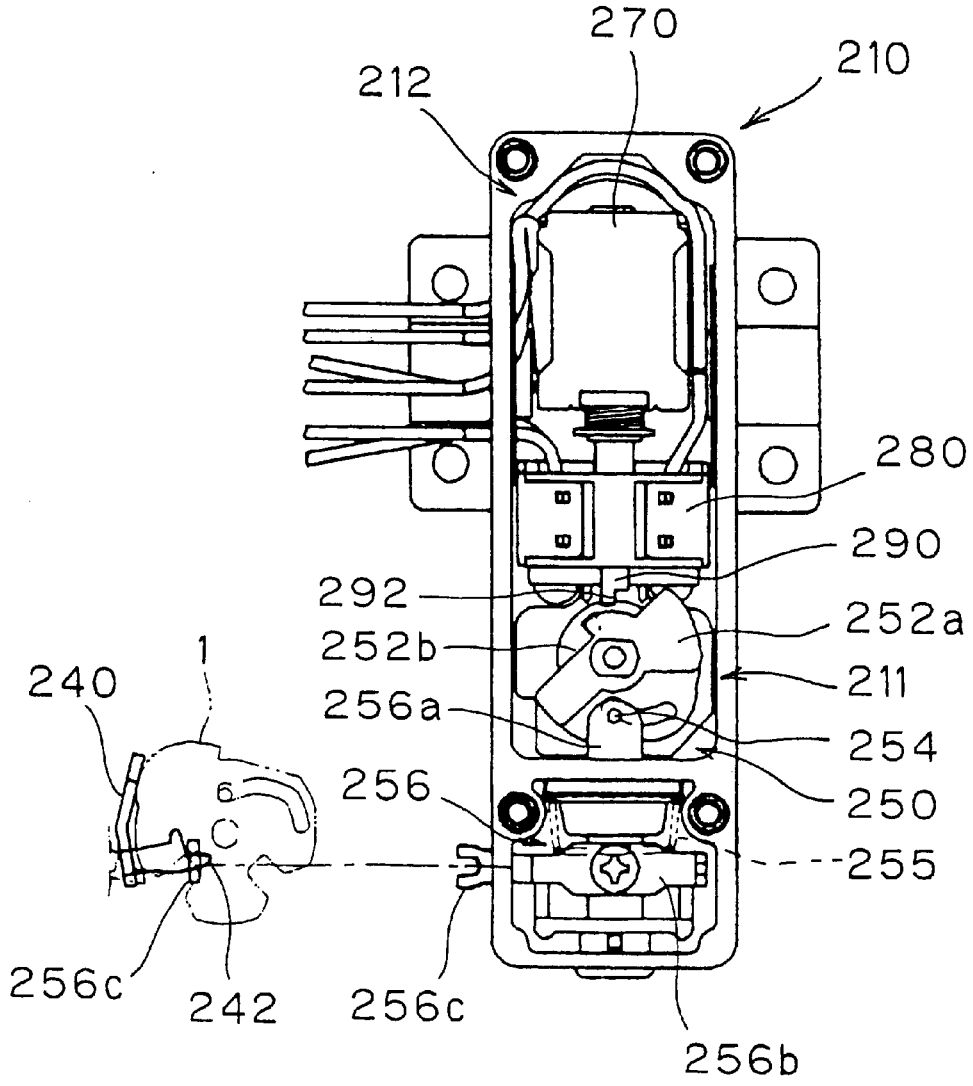
FIG. 12 is a plan view showing another state of the lock mechanism body without the cover according to the first embodiment hereof.

In State 2, the turning of the key (operation piece) 260 in the unlocking direction brings the first and second cams 252*a*, 252*b* of the operation cam into rotation which causes the insert pin 254 to move along the cam groove 253, as shown in FIG. 12. This causes the move body 256 to advance against the spring 255 and then, the insert pin 254 is locked in the pin locking portion 253*a*. The state of the key (operation piece) 260 turned in the unlocking direction will hereinafter be referred to as "State 3".

The advancement of the move body 256 causes the U-body 256*c* to urge the lower end of the one engagement piece 242 of the lock body 240 in the advance direction so that the lock body 240 rotates about the support piece 241 in the direction to bring the locking piece 243 away from the drive cam 1 and control plates 2, 3. This releases the locking piece from the lock steps 1*d*, 2*c* and 3*c* of the drive cam 1 and control plates 2, 3 thereby permitting the rotation of the drive cam 1 and control plates 2, 3. Accordingly, the actuator 220 can be drawn out of place by opening the door 230. The state of the actuator 220 thus removed will hereinafter be referred to as "State 4".

In State 4, the actuator 220 is not inserted and therefore, an attempt to turn the inserted key (operation piece) 260 in the locking direction is reacted as follows. While the turning of the key (operation piece) 260 tends to retreat the move body 256 to Lock position, the U-body 256*c* urges the lower end of the one engagement piece 242 of the lock body 240 in the retreat direction, bringing the lock body 240 into rotation about the support piece 241 to present its locking piece to the drive cam 1 and control plates 2, 3. Thus, the locking piece 243 abuts against the peripheries of the great radius portions of the drive cam 1 and control plates 2, 3 thereby disabling the further rotation of the lock body 240. The lock body 240 so constrained inhibits the move body 256 from retreating to Lock position. As a result, the key (operation piece) 260 cannot be turned.

Figure 13:
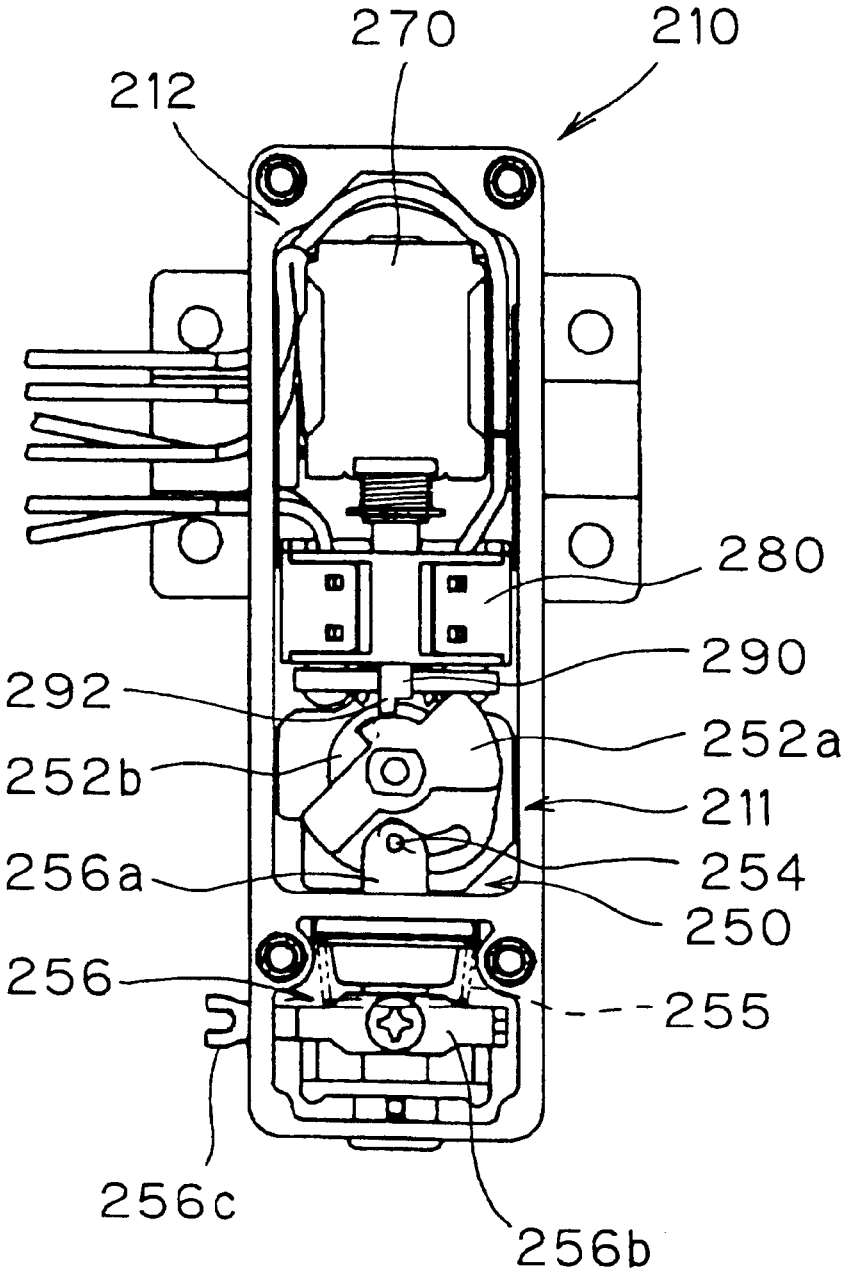
FIG. 13 is a plan view showing yet another state of the lock mechanism body without the cover according to the first embodiment hereof.

When the solenoid (drive portion) 270 is deexcited in State 4, the plunger (operative portion) 290 tends to move in the retreat direction as urged by the spring 291. However, the distal end of the plunger abuts against the periphery of the first cam 252*a* of the operation cam, as shown in FIG. 13. Accordingly, the plunger (operative portion) 290 is inhibited from retreating thereby maintaining the auxiliary contact 280 at the open position. The state where the auxiliary contact 280 is kept open by the inhibition of the retreat of the plunger (operative portion) 290 will hereinafter be referred to as "State 5".

In State 5, when the door 230 is closed to insert the actuator 220 into the operation section 202, the drive cam 1 and control plates 2, 3 rotate to advance the operative rod 8 thereby closing the connection contact of the contact block 9. On the other hand, the rotation of the drive cam 1 and control plates 2, 3 locates the locking piece 243 of the lock body 240 on the peripheries of the small radius portions of the drive cam 1 and control plates 2, 3 and hence, the lock body 240 is allowed to rotate. The state of the lock body 240 allowed to rotate will hereinafter be referred to as "State 6".

In State 6, when the key (operation piece) 206 is inserted in the key-insertion portion 251 and turned in the locking direction, the spring 291 is allowed by the deexcited solenoid (drive portion) 270 to urge the plunger (operative portion) 290 back to its retreat position, the distal end of the plunger (operative portion) 290 slidably moving from the great radius portion to the small radius portion of the first cam 252*a* rotated by the key (operation piece) 260 in the locking direction. Thus, the auxiliary contact 280 is closed thereby to close the main circuit so that the power is supplied to the industrial machine connected to the main circuit. Then, the operations return to State 1.

The safety switch assembly is adapted to close the main circuit only when the solenoid (drive portion) 270 of the auxiliary lock mechanism 212 is deexcited (non-operative), the switchable portion 250 of the main lock mechanism 211 is at Lock position, and the actuator 220 is inserted.

Accordingly, even if the door 230 is open with the actuator 220 uninserted and then is accidentally closed to insert the actuator 220 despite the presence of the operator in the room, the key (operation piece) 260 removed from the main lock mechanism 211 positively prevents the industrial machine from being energized via the closure of the main circuit, unless the steps are taken which include re-inserting the key (operation piece) 260 in the key-insertion portion 251, deexciting the solenoid (drive portion) 270 of the auxiliary lock mechanism 212, and turning the key (operation piece) 260 in the locking direction.

When the key (operation piece) 260 is removed, the door is unlocked so that the lock body 240 is unlocked (with the drive cam 1 and control plates 2, 3 rotated). Therefore, the closure of the door 230 does not result in the locked state (the door 230 disabled from opening) even if it is closed. The door 230 can be opened again so that the operator is protected from being locked in the room.

In addition, it is ensured that the operator removes the key (operation piece) 260 and then enters the room bringing the key 260 with him. As long as the operator brings the key (operation piece) 260 with him when entering the room for maintenance services of the industrial machine, it never occurs that the main circuit is closed to energize the industrial machine being inspected. Hence, the operator can carry out the maintenance services with safety.

According to the first embodiment, the main circuit is closed only when the solenoid (drive portion) 270 of the auxiliary lock mechanism 212 is deexcited (non-operative), the switchable portion 250 is at Lock position, and the door 230 is closed to insert the actuator 220. This ensures the prevention of the event that the door 230 is inadvertently closed to energize the industrial machine in the presence of the operator in the room (dangerous zone) or that the operator is locked in the room (dangerous zone).

Unless the door 230 is closed to insert the actuator 22, the switchable portion 250 is disallowed to transfer to Lock position, resulting in the inhibition of the turning of the key (operation piece) 260. Hence, the main circuit is kept open even if the door 230 is inadvertently closed to insert the actuator 220 despite the presence of the operator in the room (dangerous zone). In this case, the key (operation piece) 260 is allowed to turn in the locking direction only after the actuator 220 is inserted by closing the door 230. This uniquely defines the operation procedure for closing the main circuit such that the main circuit cannot be closed unless the given procedure is followed. This contributes to further enhanced safety.

(Second Embodiment)

Figure 14:
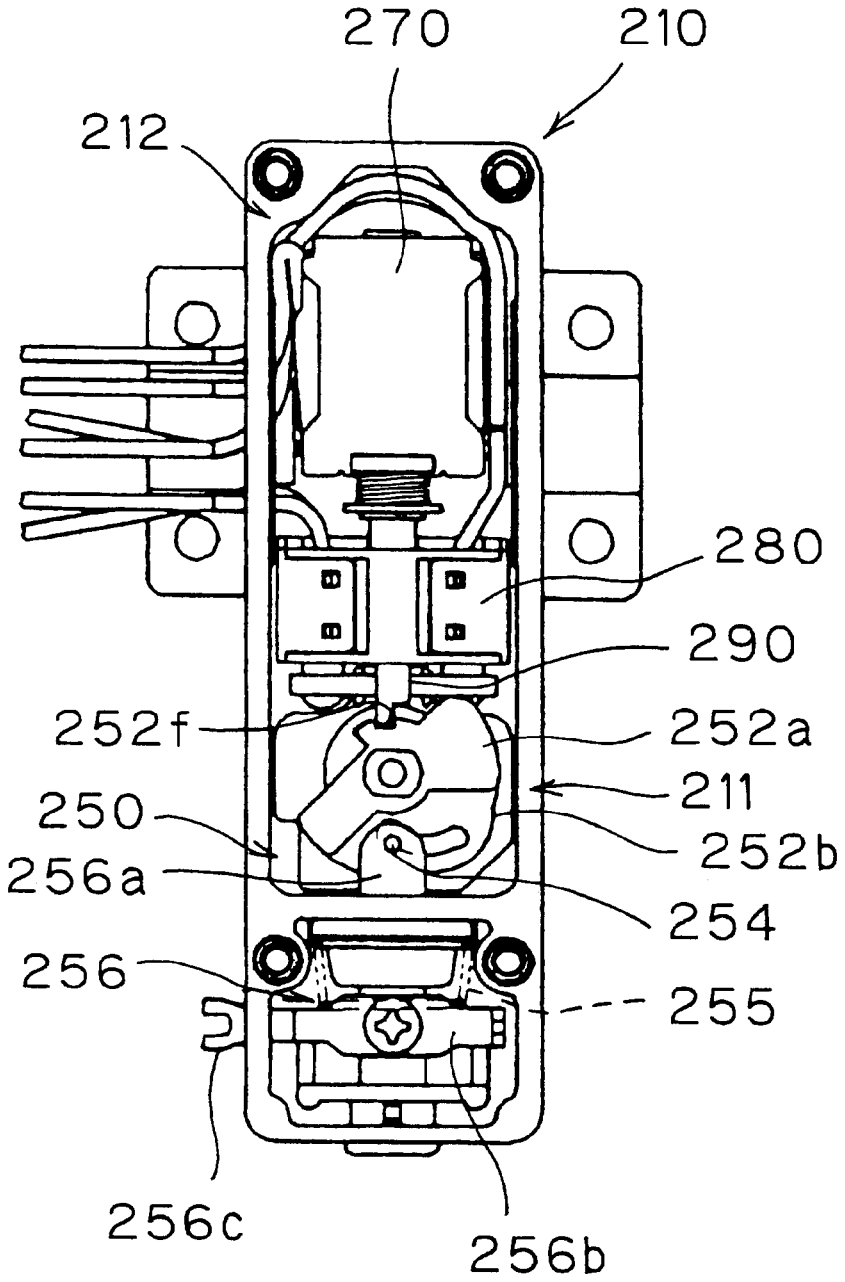
FIG. 14 is a plan view showing a lock mechanism body without a cover according to a second embodiment hereof.

According to a second embodiment of the invention, the first cam 252*a* of the operation cam may be formed with a recess 252*f* in the periphery thereof for disengageably receiving the projection 292 at the distal end of the plunger (operative portion) 290, as shown in FIG. 14.

In this arrangement, the engagement between the projection 292 and the recess 252f inhibits the rotation of the operation cam or the turning of the key (operation piece) 260 thereby maintaining the move body 256 at Unlock position. On the other hand, the excited solenoid (drive portion) 270 attractively moves the plunger (operative portion) 290, thereby disengaging the projection 292 at the distal end of the plunger (operative portion) 290 from the recess 252*f*. Thus, the rotation of the operation cam or the turning of the key (operation piece) 260 is permitted.

According to the arrangement of FIG. 14, the turning of the key (operation piece) 260 is not permitted unless the solenoid (drive portion) 270 is excited. That is, the safety of the operator is further enhanced because the key (operation piece) 260 cannot be turned in the locking direction.

(Third Embodiment)

According to a third embodiment of the invention, the key (operation piece) 260 of the second embodiment may be used not only for the On/OFF control of the main circuit for power supply to the industrial machine in the room but also for the drive of other systems.

In a case where another system is installed in the room as the dangerous zone, the operator may enter the room after removing the key (operation piece) 260 from the main lock system 211 and perform the maintenance services on another system with safety.

The constraining means for constraining the lock body 240 for the inhibition of transfer of the move body from Unlock position to Lock position is not necessarily limited to the U-body 256*c* illustrated in the first and second embodiments which is formed integrally with the operative body 256. An alternative arrangement may be made, as shown in FIG. 15, wherein one end of the operative body 256*b* is extended into the recess 11*a* of the switch body 200 to engage the lower end of the one engagement piece 242 of the lock body 256*b*, thereby urging the lower end of the engagement piece in the advance direction (advance) only when the move body 256 transfers from Lock position to Unlock position.

Figure 15:
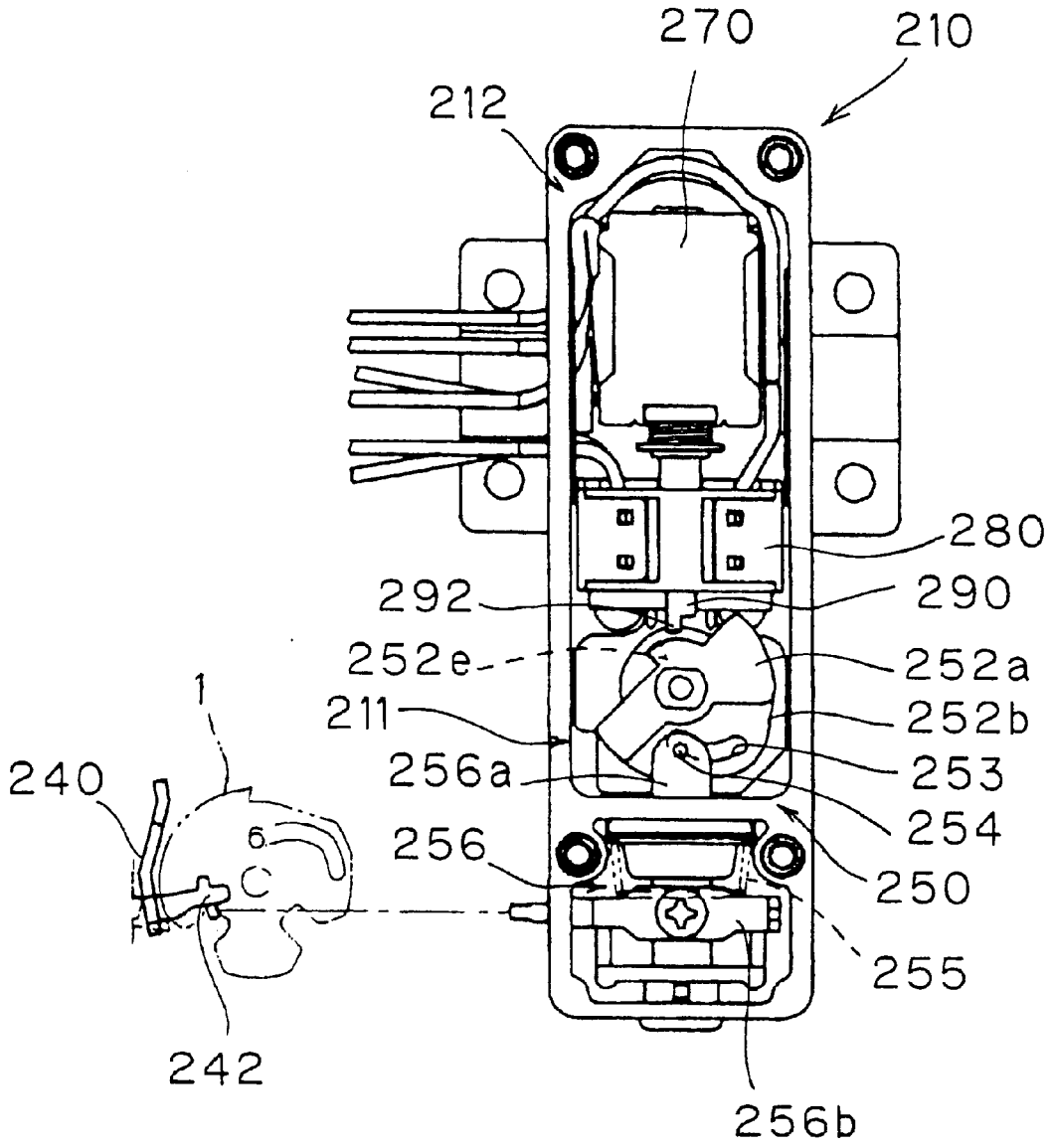
FIG. 15 is a plan view showing a lock mechanism body without a cover according to a third embodiment hereof.
Figure 16:
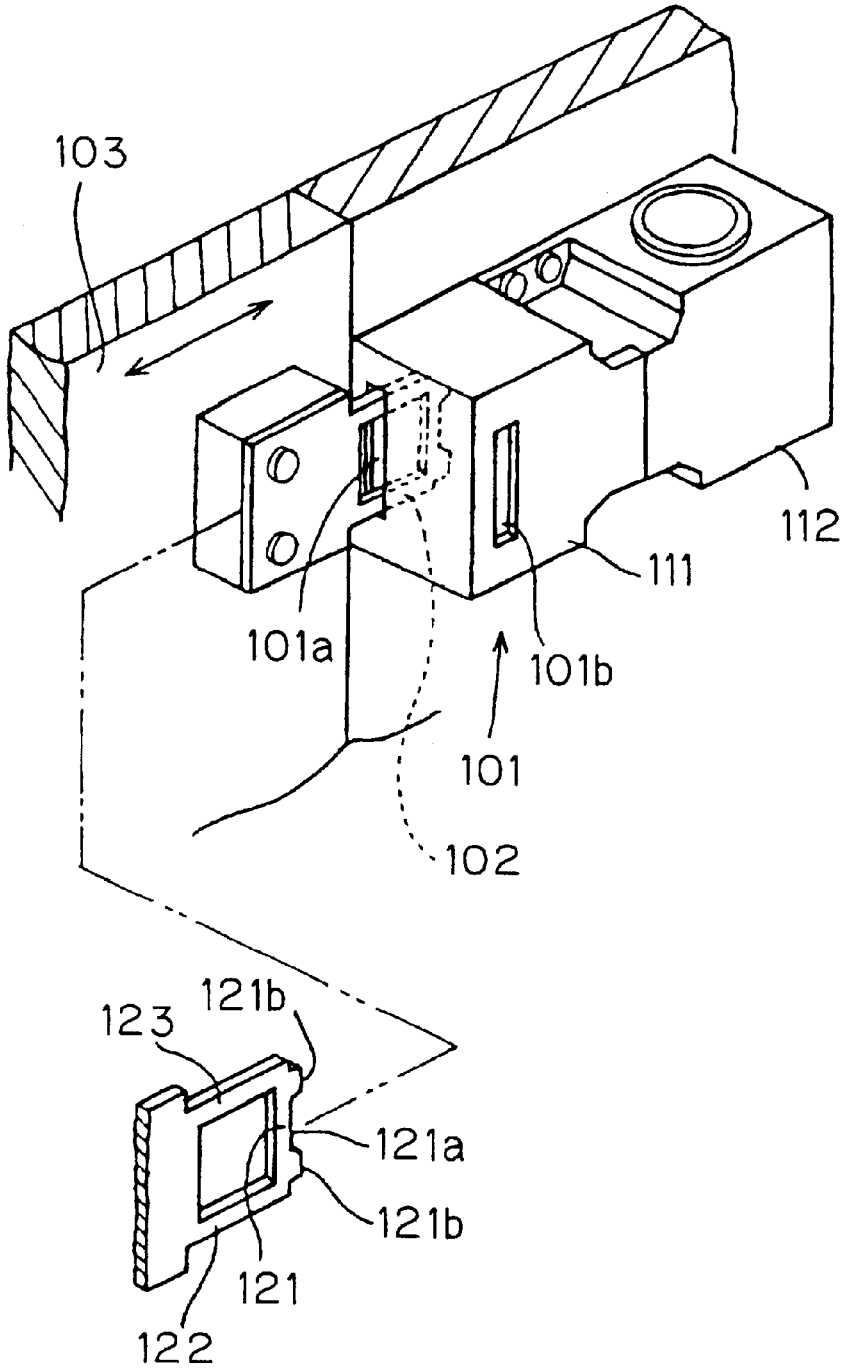
FIG. 16 is a perspective view showing a state of a background art example of the invention.
Figure 17:
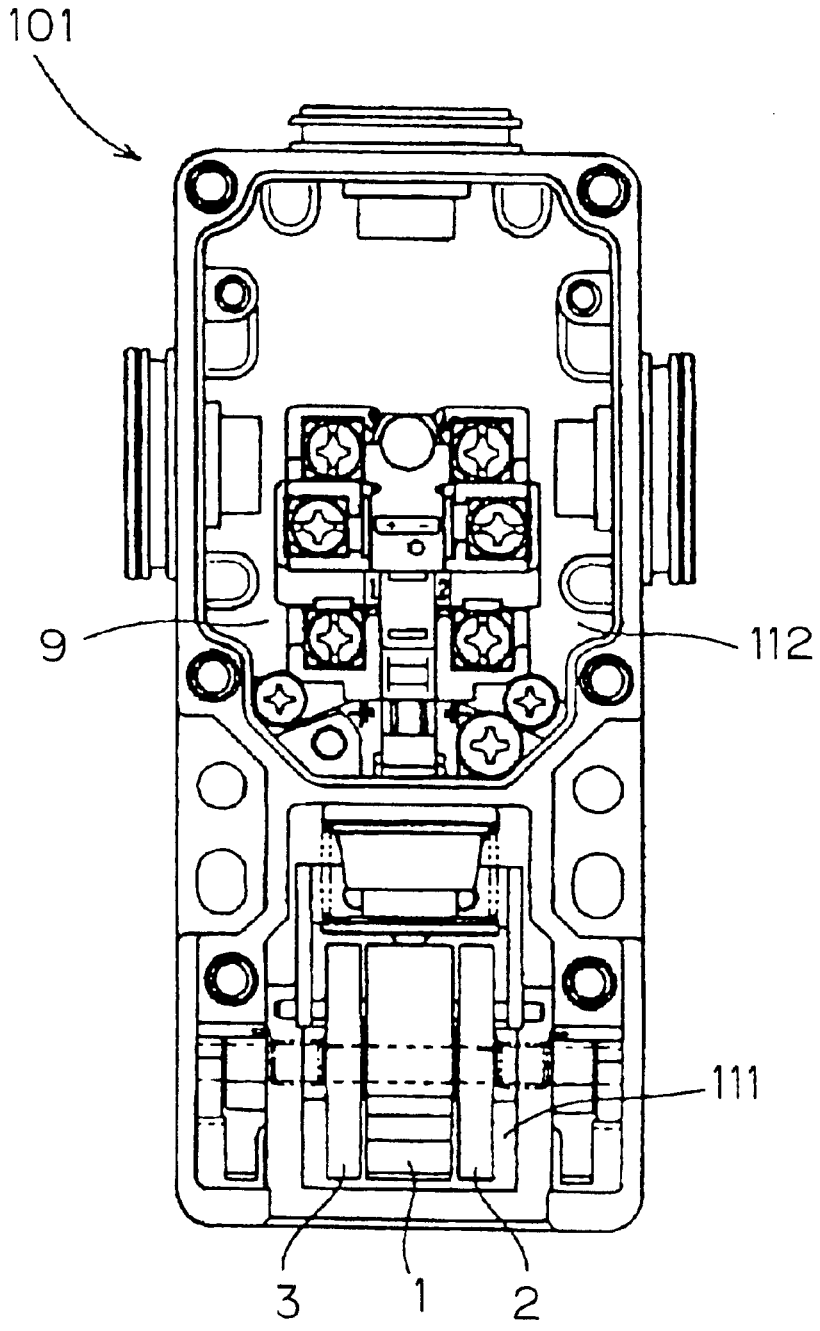
FIG. 17 is a plan view showing the background art example hereof without a cover.
Figure 18:
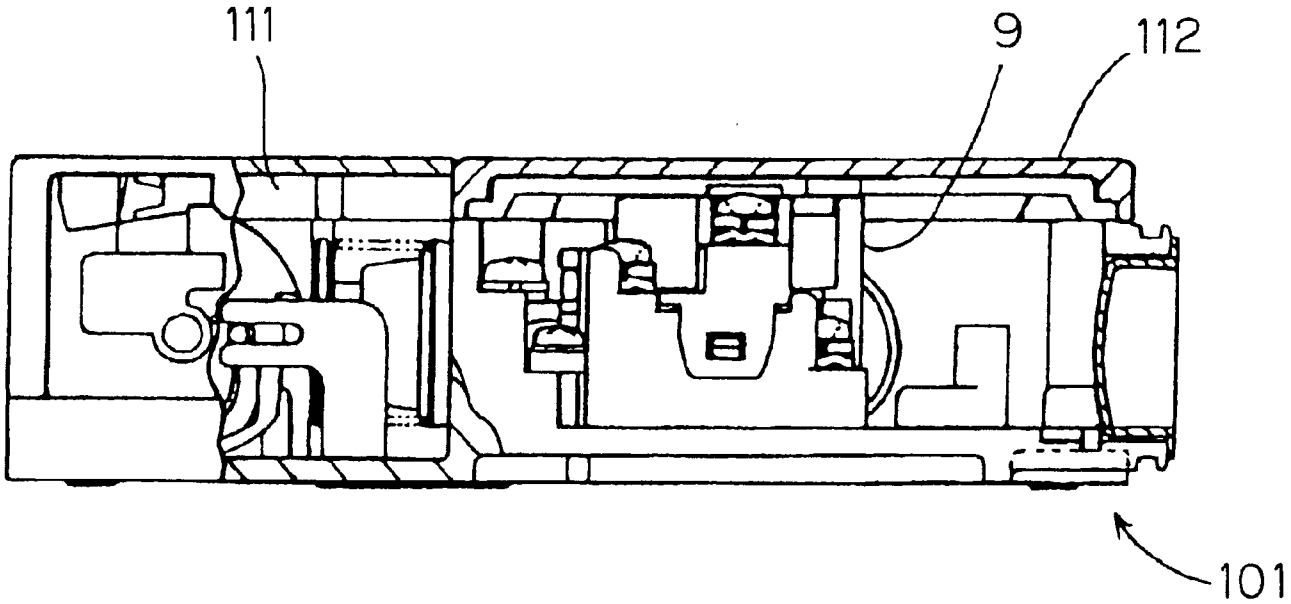
FIG. 18 is a side view showing the background art example hereof with the cover broken away.
Figure 19:
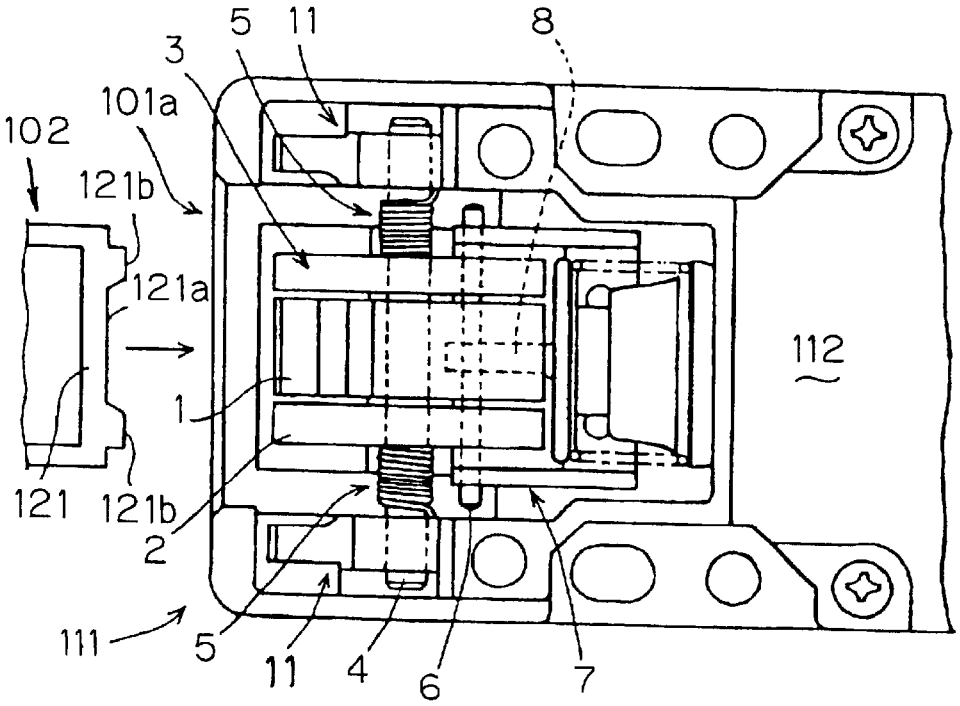
FIG. 19 is a plan view showing a part of the background art example hereof with the cover broken away.
Figure 20:
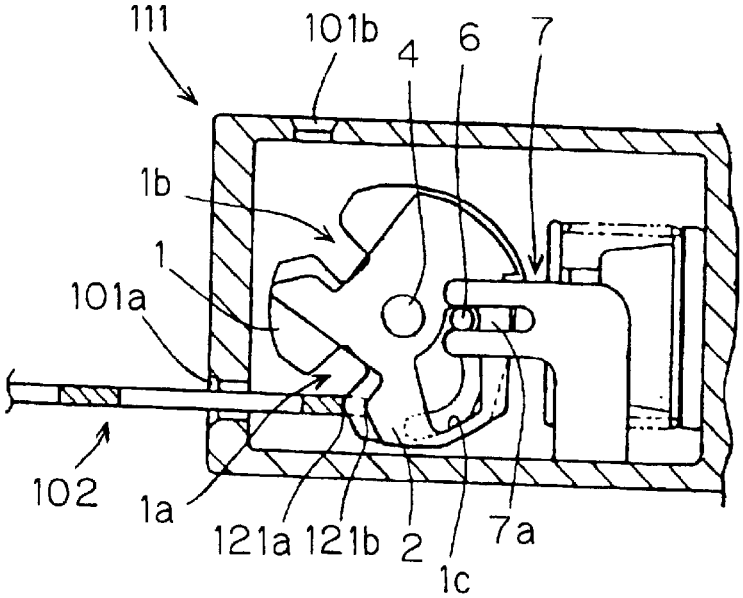
FIG. 20 is a side view showing a part of the background art example hereof with the cover broken away.
Figure 21:
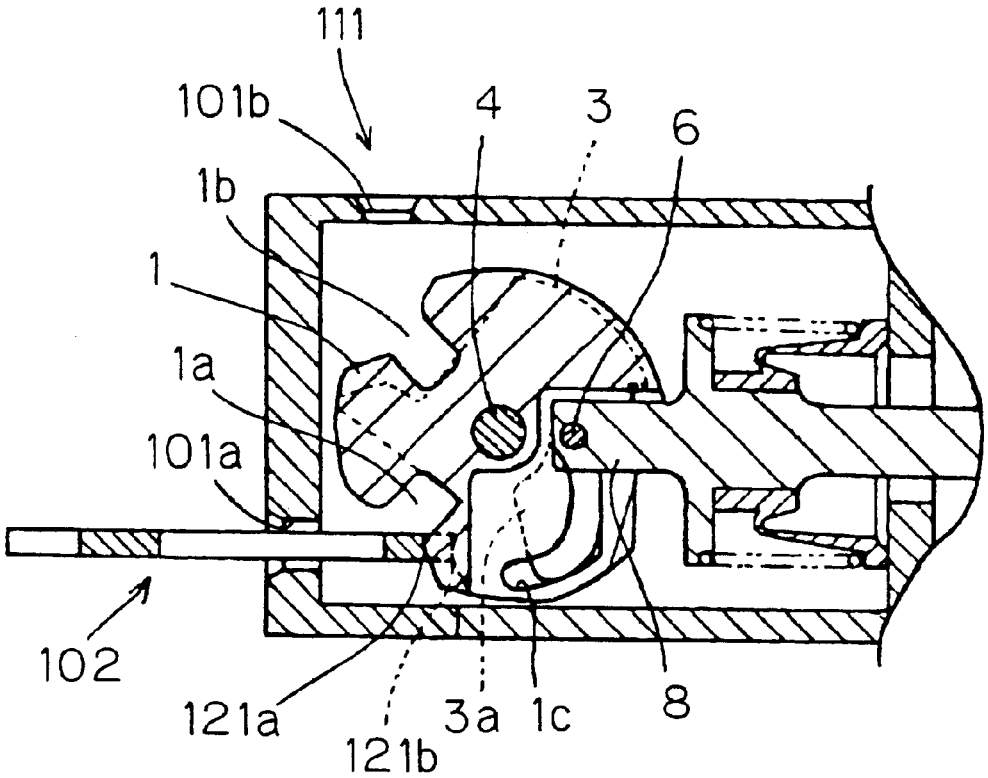
FIG. 21 is a vertical section taken along the line on the center of a part of the background art example hereof.

As shown in FIG. 15, the drive cam 1 may be configured to dispense with the extension, shown in FIG. 12, at the great radius portion thereof so that the locking piece 243 of the lock body 240 may not abut against the periphery of the great radius portion of the drive cam 1. This permits the key (operation piece) 260 to be turned in both the locking direction and the unlocking direction regardless of the ingress or egress of the actuator 220. This excludes the unique definition of the operation procedure for closing the main circuit.

If the drive cam 1 of FIG. 12 is configured to dispense with the extension at the great radius portion thereof as shown in FIG. 15, then the locking piece 243 of the lock body 240 does not abut against the periphery of the great radius portion of the drive cam 1. Hence, the key (operation piece) 260 can be turned in both the locking direction and the unlocking direction regardless of the ingress or egress of the actuator 220.

According to the description of the foregoing embodiments, the drive cam 1 is provided with the control plates 2,3 on the opposite sides thereof so that the operative rod 8 may be advanced only by the substantially simultaneous depression of the drive cam 1 and the control plates. However, the control plates 2,3 are not always required. It is apparent that the invention can be implemented the same way when the operation section 202 of the switch body 200 is provided with the drive cam 1 alone.

According to the description of the foregoing embodiments, the operation piece 260 of the main lock mechanism 211 is implemented in the key whereas the switchable portion 250 is implemented in the combination of the key-insertion portion 251, the operation cam including the first and second cams 252*a,* 252*b,* the cam groove 253 defined in the second cam 252*b,* the insert pin 254 and the move body 256 urged by the spring 255. However, the arrangement should not be limited to the above but the switchable portion may be arranged in any way as long as it is at least selectively switchable between Lock position and Unlock position. On the other hand, the operation piece may be arranged in any way as long as the operation piece is removably mounted to the switchable portion for selective switching of the switchable portion and becomes removable at the transfer of the switchable portion to Unlock position.

According to the description of the foregoing embodiments, the drive portion 270 of the auxiliary lock mechanism 212 is implemented in the solenoid whereas the operative portion 290 is implemented in the plunger attracted by the excited solenoid. As a matter of course, the drive portion 270 and operative portion 290 should not be limited to the solenoid and plunger, respectively. In short, the drive portion may be implemented in anything that is operated by the trigger externally applied when the switchable portion of the main lock mechanism is switched to Lock position. The operation piece may be implemented in anything that maintains the switchable portion at Lock position for keeping the auxiliary contact closed when the drive portion is non-operative and that permits the transfer of the switchable portion to Unlock position when the drive portion is operative.

The dangerous zone is not limited to the specific room mentioned supra, but an equivalent effect to the foregoing embodiments may be attained by applying the invention to any space that is defined by a partitioning element with an open/close element, such as a door, and permits the installation of the electric equipment such as the industrial machine.

According to the description of the foregoing embodiments, the constraining means is implemented in the U-body 256*c* formed integrally with the operative body 256*b* of the move body 256. However, the constraining means should not be limited to the U-body 256*c* but may be of any arrangement that is at least capable of constraining the lock body for inhibiting the transfer of the switchable portion from Unlock position to Lock position when the actuator is not inserted. Specifically, the constraining means may be implemented in an arrangement wherein a part of the operative body 256*b* is inserted in a hole defined in one of the engagement pieces 242 of the lock body 240.

As mentioned supra, the safety switch assembly of the invention permits the main circuit to be closed only when the drive portion of the auxiliary lock mechanism is non-operative, the switchable portion of the main lock mechanism is at Lock position, and the actuator is inserted. This is effective to prevent the occurrence of an event that the industrial machine is energized by the inadvertent closure of the door in the presence of the operator in the dangerous zone or that the operator is locked in the dangerous zone. Hence, the safety of the operator working in the dangerous zone is further improved.

What is claimed is:

1. A safety switch assembly for providing ON/OFF control of a main circuit comprising:

a switch body having an operation section with an actuator;

a switch section having an operative rod displaceable by said actuator;

a connection contact for closing a connection to the main circuit which is switched by the operative rod;

an operation section including a drive cam formed with a lock step in its periphery and rotated according to ingress or egress of the actuator;

a main lock mechanism juxtaposed with the switch body and including:

a switchable portion selectively switched between Lock position and Unlock position, an operation piece removably mounted to the switchable portion for switching operation of the switchable portion and removable at transfer of the switchable portion to Unlock position; and a lock body which, during the ingress of the actuator, is locked to the lock step as interlocked with the switchable portion switched to Lock position thereby disabling the rotation of the drive cam for inhibition of the egress of the actuator and is released from the lock step as interlocked with the switchable portion switched to Unlock position thereby enabling the rotation of the drive cam for permission of the egress of the actuator, an auxiliary lock mechanism juxtaposed with the switch body and including:

a drive portion operated by a trigger signal externally applied when the switchable portion is at Lock position;

an auxiliary contact connected in series with the main circuit jointly with the connection contact; and an operative portion which, during a non-operative state of the drive portion, maintains the switchable portion at Lock position for keeping the auxiliary contact closed and which, during an operative state of the drive portion, permits transfer of the switchable portion to Unlock position for opening the auxiliary contact;

wherein the main circuit is closed on condition that the drive portion of the auxiliary lock mechanism is non-operative, the switchable portion of the main lock mechanism is at Lock position, and the actuator is inserted.

2. A safety switch assembly as claimed in claim 1, wherein constraining means is provided for constraining the lock body for inhibition of the transfer of the switchable portion from Unlock position to Lock position when the actuator is not inserted.

3. A safety switch assembly as claimed in claim 1 or 2, wherein:

the operation piece is a key;

the switchable portion is a key-insertion portion for receiving the key; and said operation section includes:

an operation cam rotated by turning the key inserted in the key-insertion portion;

a cam groove defined in the operation cam;

an insert pin inserted in the cam groove;

urging means; and a moveable body which is urged by the urging means in an egress direction of the actuator but is moved from Lock position to Unlock position against the urging means as interlocked with the insert pin moved by the rotation of the operation cam.

4. A safety switch assembly as claimed in claim 3, further comprising the drive portion of the auxiliary lock mechanism including a solenoid excited by the trigger signal;

the operative portion of the auxiliary lock mechanism including a plunger attractively moved by the excited solenoid and urged back to its initial place by the urging means when the solenoid is deexcited;

the operation cam having a recess for removably receiving a distal end of the plunger;

wherein the plunger has a distal end received by the recess thereby inhibiting the rotation of the operation cam for maintaining the move body at Unlock position, wherein the plunger is attractively moved to disengage its distal end from the recess thereby permitting the rotation of the operation cam.

5. A safety switch assembly as claimed in claim 1 or 2, wherein the operation piece includes one that is also used for the drive of a system besides the main circuit.

6. A safety switch assembly as claimed in any one of claims 1 or 2, wherein the trigger signal is applied by a manual operation or a control unit on condition that an electrical equipment connected to the main circuit is shut down.

7. A safety switch assembly as claimed in claim 1, wherein:

the switch body is secured near a doorway formed in a partitioning wall defining a specific area in a building;

the actuator is secured to a door disposed at the doorway; and the actuator is removable from the operation section by opening the door such that the operation piece is removable from the switchable portion.

* * * * *